US006786483B2

(12) United States Patent
Nishimura et al.

(10) Patent No.: US 6,786,483 B2
(45) Date of Patent: Sep. 7, 2004

(54) SHEET PROCESSING APPARATUS AND IMAGE FORMING SYSTEM HAVING THE SAME

(75) Inventors: Shunsuke Nishimura, Ibaraki (JP); Yoshinori Isobe, Ibaraki (JP)

(73) Assignee: Canon Kabushiki Kaisha (JP)

( * ) Notice: Subject to any disclaimer, the term of this patent is extended or adjusted under 35 U.S.C. 154(b) by 11 days.

(21) Appl. No.: 10/227,172

(22) Filed: Aug. 23, 2002

(65) Prior Publication Data

US 2003/0057632 A1 Mar. 27, 2003

(30) Foreign Application Priority Data

Aug. 23, 2001 (JP) ..... 2001-253189

(51) Int. Cl.[7] ..... B65H 5/34
(52) U.S. Cl. ..... 271/270; 271/176; 271/314
(58) Field of Search ..... 271/176, 314, 271/258.9, 276

(56) References Cited

U.S. PATENT DOCUMENTS 6,139,012 A * 10/2000 Furuya et al. ..... 271/314
6,530,569 B2 * 3/2003 Yamagishi ..... 271/270

* cited by examiner

*Primary Examiner*—Donald P. Walsh
*Assistant Examiner*—Kaitlin Joerger
(74) *Attorney, Agent, or Firm*—Rossi & Associates

(57) ABSTRACT

There is provided a sheet processing apparatus that is capable of preventing sheets conveyed to the sheet processing apparatus from being skewed, wrinkled, damaged, or jammed, and prevent sheets stored in the sheet processing apparatus from being misaligned. The sheet processing apparatus receives a sheet discharged from an image forming apparatus comprising fixing rollers that hold and convey a sheet on which is formed an image at a first conveying speed and with a first conveying force, discharge rollers disposed downstream of the fixing rollers in a sheet conveying direction, for conveying the sheet at a second conveying speed higher than the first conveying speed and with a second conveying force smaller than the first conveying force, and a controller that determines whether a trailing end of the sheet is released from the fixing rollers. In the sheet processing apparatus, sheet discharge rollers convey the received sheet, and a controller sets the conveying speed of the sheet discharge rollers to the first conveying speed while the sheet is being conveyed by all of the fixing rollers, the discharge rollers, and the sheet discharge rollers, and sets the conveying speed of the sheet discharge rollers to the second conveying speed after the controller determines that the trailing end of the sheet is released from the fixing rollers.

17 Claims, 23 Drawing Sheets

SHEET PROCESSING APPARATUS AND IMAGE FORMING SYSTEM HAVING THE SAME

BACKGROUND OF THE INVENTION

1. Field of the Invention

The present invention relates to a sheet processing apparatus that receives and processes sheets discharged from an image forming apparatus, and an image forming system including the image forming apparatus and the sheet processing apparatus.

2. Description of the Related Art

Conventionally, an image forming apparatus such as a copying machine has fixing rollers that fix toner on a recording sheet and discharge rollers that are disposed downstream of the fixing rollers in a sheet conveying direction to discharge the recording sheet. The fixing rollers and the discharge rollers are controlled to rotate at different rotational speeds. The rotational speed of the discharge rollers is set to be higher than that of the fixing rollers. This is to prevent a sheet having absorbed heat on the fixing rollers from shrinking when it is self-cooled.

The conveying force of the discharge rollers is set to be smaller than that of the fixing rollers in order to prevent the sheet from being pulled from the fixing rollers at the rotational speed of the discharge rollers. Thereby, the fixing process is properly performed by conveying a sheet at the rotational speed of the fixing rollers. Therefore, the sheet is prevented from being pulled in such a way as to slide on the fixing rollers, and is conveyed at a conveying speed based on the rotational speed of the fixing rollers insofar as it is held by the fixing rollers.

After the trailing end of the sheet is released from the fixing rollers, the sheet is conveyed only by the discharge rollers. Hence, the sheet is conveyed at a higher conveying speed than the conveying speed at which it is conveyed by the fixing rollers.

However, in a case where the image forming apparatus is equipped with a sheet processing apparatus that receives and processes sheets discharged from the image forming apparatus, second discharge rollers of the sheet processing apparatus are provided downstream of the discharge rollers of the image forming apparatus in the sheet conveying direction. Thus, depending upon the length of a sheet, there can be timing in which the sheet is held by the fixing rollers, the discharge rollers of the image forming apparatus and the second discharge rollers of the sheet processing apparatus at the same time while the sheet is being conveyed. In such an event, if the second discharge rollers of the sheet processing apparatus rotate at the same rotational speed as the discharge rollers of the image forming apparatus, the second discharge rollers run idle since the sheet is conveyed at a conveying speed based on the rotational speed of the fixing rollers, whereby the sheet can be injured.

Further, in a case where the rotational speed of the second discharge rollers is equal to that of the fixing rollers, the sheet is conveyed by the discharge rollers and the second discharge rollers after the trailing end of the sheet is released from the fixing rollers. Since the rotational speed of the discharge rollers is higher than that of the second discharge rollers, the sheet becomes curved, i.e. the sheet is formed into a loop between the discharge rollers and the second discharge rollers. The formation of the loop deteriorates the conveying accuracy, skews, wrinkles, damages, and jams the sheet, and causes other problems. Further, the formation of the loop causes poor alignment of sheets housed in the sheet processing apparatus.

SUMMARY OF THE INVENTION

It is therefore an object of the present invention to provide a sheet processing apparatus, and an image forming system having an image forming apparatus and the sheet processing apparatus that are capable of preventing sheets conveyed to the sheet processing apparatus from being skewed, wrinkled, damaged, or jammed, and prevent sheets stored in the sheet processing apparatus from being misaligned.

To attain the above object, in a first aspect of the present invention, there is provided a sheet processing apparatus that receives a sheet discharged from an image forming apparatus comprising first conveying means for conveying a sheet on which is formed an image at a first conveying speed and with a first conveying force, second conveying means disposed downstream of the first conveying means in a sheet conveying direction, for conveying the sheet at a second conveying speed higher than the first conveying speed and with a second conveying force smaller than the first conveying force, and determination means for determining whether a trailing end of the sheet has been released from the first conveying means, the sheet processing apparatus comprising third conveying means for conveying the received sheet, and conveying speed setting means for setting a conveying speed of the third conveying means to the first conveying speed while the sheet is being conveyed by all of the first conveying means, the second conveying means, and the third conveying means, and for setting the conveying speed of the third conveying means to the second conveying speed after the determination means determines that the trailing end of the sheet has been released from the first conveying means.

Preferably, the conveying speed setting means sets the conveying speed of the third conveying means to the second conveying speed when the determination means determines that the trailing end of the sheet has been released from the first conveying means before a leading end of the sheet reaches the third conveying means.

Also preferably, the conveying speed setting means is responsive to release of the trailing end of the sheet from the second conveying means, for setting the conveying speed of the third conveying means to a third conveying speed higher than the second conveying speed.

In a preferred form of the first aspect, the first conveying means comprises fixing means for fixing an image on the sheet while conveying the sheet.

In another preferred form of the first aspect, the sheet processing apparatus comprises an original reading apparatus that reads an original, provided at an upper side of the image forming apparatus, and the sheet processing apparatus is provided between the image forming apparatus and the original reading apparatus.

According to the first aspect of the present invention, there is provided a sheet processing apparatus that is comprised of third conveying means for conveying the received sheet, and conveying speed setting means for setting the conveying speed of the third conveying speed to the first conveying speed while the sheet is being conveyed by all of the first conveying means, the second conveying means, and the third conveying means, and for setting the conveying speed of the third conveying means to the second conveying speed after the determination means determines that the trailing end of the sheet has been released from the first conveying means. As a result, it is possible to prevent the sheet from being skewed, wrinkled, damaged, jammed, or the like, and prevent sheets stored in the sheet processing apparatus from being misaligned in both of the cases where it is being conveyed all of the first, second and third conveying means and where the trailing end of the sheet has been released from the first conveying means.

To attain the above object, in a second aspect of the present invention, there is provided a sheet processing apparatus that receives a sheet discharged from an image forming apparatus comprising first conveying means for conveying a sheet on which is formed an image at a first conveying speed and with a first conveying force, second conveying means disposed downstream of the first conveying means in a sheet conveying direction, for conveying the sheet at a second conveying speed higher than the first conveying speed and with a second conveying force smaller than the first conveying force, and determination means for determining whether a trailing end of the sheet has been released from the first conveying means, the sheet processing apparatus comprising third conveying means for conveying the received sheet, and conveying speed setting means for setting a conveying speed of the third conveying speed to the first conveying speed or the second conveying speed according to information on a size of the sheet received from the image forming apparatus.

Preferably, the conveying speed setting means sets the conveying speed of the third conveying means to the second conveying speed when a sheet length indicated by the information on the size of the sheet received from the image forming apparatus is smaller than a predetermined length, and the conveying speed setting means sets the conveying speed of the third conveying means to the first conveying speed when the sheet length indicated by the information on the size of the sheet received from the image forming apparatus is equal to or greater than the predetermined length.

Also preferably, when the conveying speed of the third conveying means is set to the first conveying means, the conveying speed setting means sets the conveying speed of the third conveying means to the second conveying speed after the determination means determines that the trailing end of the sheet has been released from the first conveying means.

Further preferably, the conveying speed setting means is responsive to release of the trailing end of the sheet from the second conveying means, for setting the conveying speed of the third conveying means to a third conveying speed higher than the second conveying speed.

According to the second aspect of the present invention, the sheet processing apparatus is comprised of the third conveying means for conveying the received sheet, and the conveying speed setting means for setting the conveying speed of the third conveying means to the first conveying speed or the second conveying speed according to the information on the size of the sheet received from the image forming apparatus. As a result, the third conveying means is capable of conveying the sheet at the conveying speed that is suitable for the size of the sheet. This prevents the sheet from being skewed, wrinkled, damaged, jammed, or the like, and prevent sheets stored in the sheet processing apparatus from being misaligned.

Preferably, the determination means comprises a sensor disposed upstream of the first conveying means in the sheet conveying direction.

In this case, a period of time U required after the determination means determines that the trailing end of the sheet has been released from the first conveying means and before the conveying speed setting means sets the conveying speed of the third conveying means to the second conveying speed is expressed by:

$$U=L2/v$$

where L2 represents a distance from the sensor to the first conveying means, and v represents the first conveying speed.

To attain the above object, in a third aspect of the present invention, there is provided an image forming system comprising an image forming apparatus, and a sheet processing apparatus, wherein the image forming apparatus comprises first conveying means for conveying a sheet on which is formed an image at a first conveying speed and with a first conveying force, second conveying means disposed downstream of the first conveying means in a sheet conveying direction, for conveying the sheet at a second conveying speed higher than the first conveying speed and with a second conveying force smaller than the first conveying force, and determination means for determining whether a trailing end of the sheet has been released from the first conveying means, and the sheet processing apparatus is a sheet processing apparatus according to the first aspect.

To attain the above object, in a fourth aspect of the present invention, there is provided an image forming system comprising an image forming apparatus and a sheet processing apparatus, wherein the image forming apparatus comprises first conveying means for conveying a sheet on which is formed an image at a first conveying speed and with a first conveying force, second conveying means disposed downstream of the first conveying means in a sheet conveying direction, for conveying the sheet at a second conveying speed higher than the first conveying speed and with a second conveying force smaller than the first conveying force, and determination means for determining whether a trailing end of the sheet has been released from the first conveying means, and the sheet processing apparatus is a sheet processing apparatus according to the second aspect.

The above and other objects, features and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing a preferred embodiment thereof.

Figure 1:
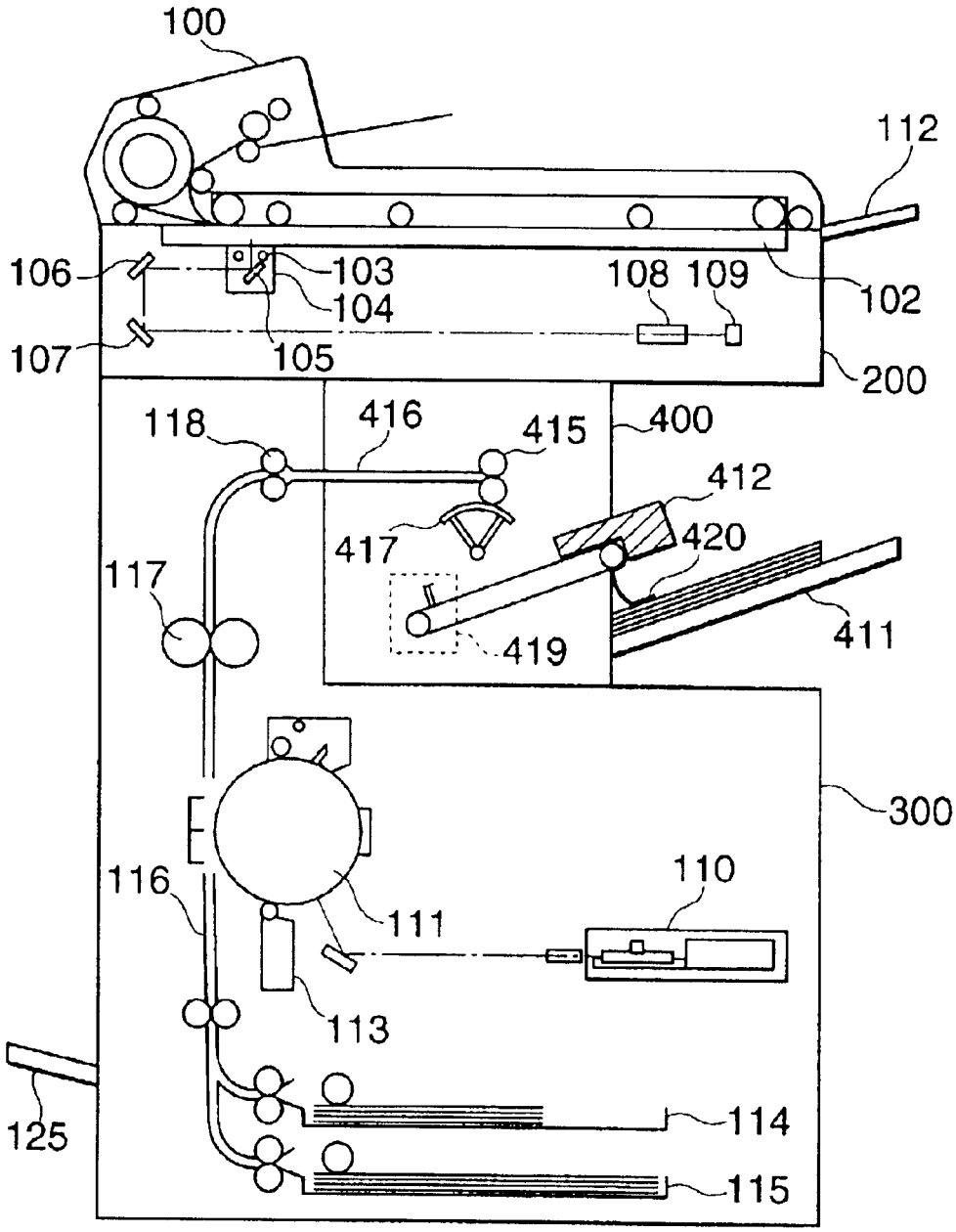
FIG. 1 is a diagram showing the construction of an image forming system including an image forming apparatus and a sheet processing apparatus according to an embodiment of the present invention.

FIG. 1 is a diagram showing the construction of an image forming system having an image forming apparatus and a sheet processing apparatus according to an embodiment of the present invention. The image forming apparatus is comprised of an image reader 200 on which is mounted an original feeder 100, and a printer 300. The image reader 200 is disposed at the upper side of the printer 300.

The original feeder 100 separates originals, which are placed with surfaces thereof on which images are formed (image surfaces) facing upward, one by one from the top one (first page), and conveys each original to a platen glass 102 on the upper side of the image reader 200 via a curved path and stops it. On this occasion, the image surface of the original faces the platen glass 102.

The image reader 200 is comprised of a scanner unit 104; optical elements such as mirrors 105, 106, 107 and a lens 108; and an image sensor 109, which are disposed below the platen glass 102.

The scanner unit 104 is comprised of a lamp 103 that irradiates light on the image surface of the original while moving back and forth on the platen glass 102. The radiated light is reflected on the original, and is guided to the image sensor 109 via the mirrors 105, 106, 107 and the lens 108, so that the image on the image surface is read. The original is then conveyed toward a discharge tray 112.

Image information on the image read by the image sensor 109 is transmitted as an image signal, after being subjected to image processing, to an exposure controller 110 in the printer 300. In the printer 300, the exposure controller 110 radiates laser light corresponding to the image signal on a photosensitive drum 111 electrified in advance. The radiation of the laser light forms an electrostatic latent image on the photosensitive drum 111. A developer 113 is disposed in the vicinity of the photosensitive drum 111. The supply of a developing agent from the developer 113 forms a developed image on the electrostatic latent image.

A transfer section 116 is disposed in the vicinity of the photosensitive drum 111. The transfer section 116 transfers the developed image on a sheet that has been conveyed from one of cassettes 114, 115 and a manual sheet feed section 125.

The sheet on which has been transferred the developed image is conveyed at a predetermined conveying speed (first conveying speed) by a pair of fixing rollers 117 (first conveying means) rotating at a predetermined rotational speed while the transferred developed image (transferred image) is fixed on the sheet. The sheet having passed the fixing rollers 117 is guided to a pair of discharge rollers 118 (second conveying means) rotating at a predetermined rotational speed.

The pair of discharge rollers 118 is capable of conveying the sheet at a predetermined conveying speed (second conveying speed), but the discharge rollers 118 conveying the sheet while holding it has a conveying force (second conveying force) weaker than the conveying force of the fixing rollers 117. Therefore, in a state in which the sheet is held by the fixing rollers 117, the sheet is conveyed at the predetermined conveying speed (first conveying speed) of the fixing rollers 117.

Downstream of the discharge rollers 118 in a conveying direction, the sheet is discharged from the printer 300 with the surface, on which is formed the transferred image, facing downward. This enables the sheets on which images are formed to be discharged in a proper order of pages if images are formed in order from the top page as in the case where the original feeder 100 is used or in the case where images outputted from a computer are printed.

The sheets discharged from the printer 300 are sent to a finisher 400 (sheet processing apparatus) mounted in the image forming apparatus. The finisher 400 carries out a binding process and other processes. The finisher 400 is arranged between the image reader 200 and the printer 300.

Figure 2:
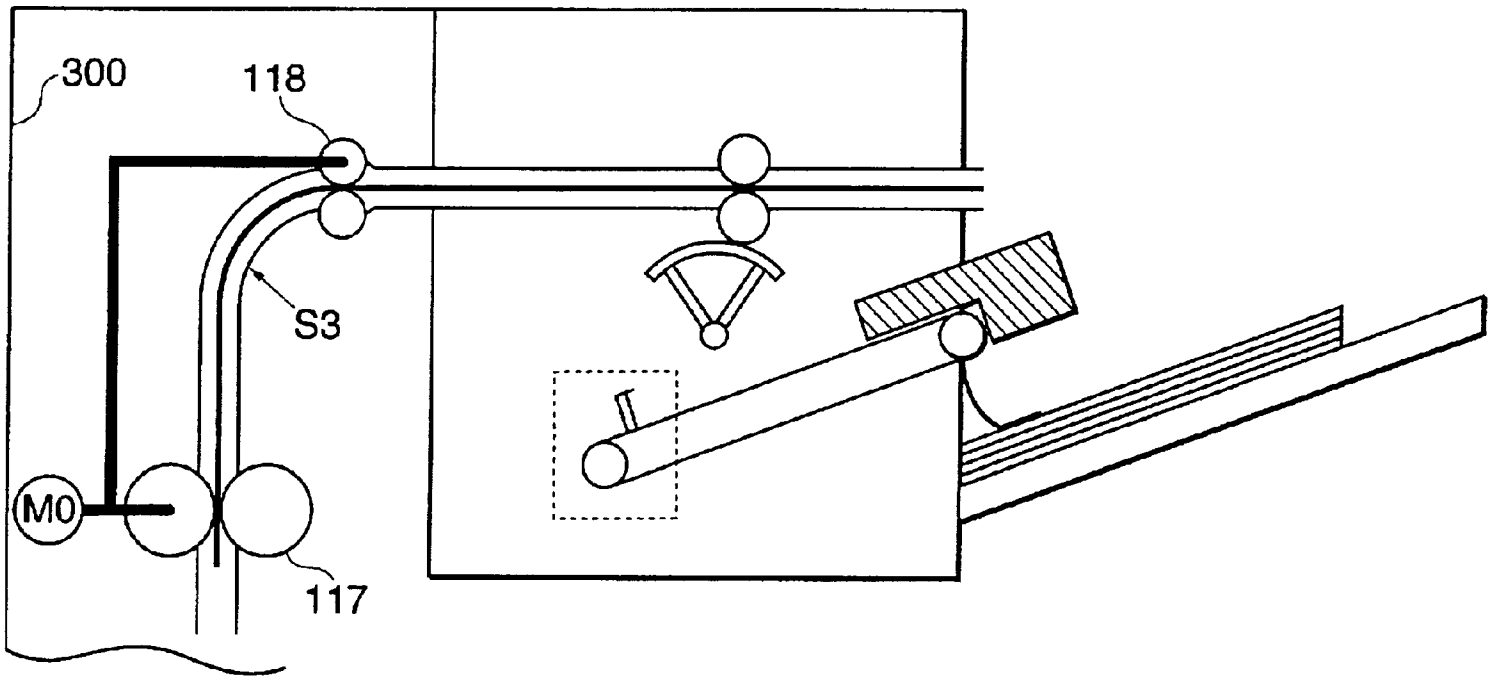
FIG. 2 is a view useful in explaining how fixing rollers 117 and discharge rollers 118 are driven in a printer 300 in FIG. 1.

FIG. 2 is a view useful in explaining how the fixing rollers 117 and the discharge rollers 118 are driven in the printer 300 in FIG. 1.

A motor M0 drives both the fixing rollers 117 and the discharge rollers 118. There are no clutches, shift gears, or the like between the motor M0 and the fixing rollers 117 and between the motor M0 and the discharge rollers 118. For this reason, the fixing rollers 117 and the discharge rollers 118 are not controlled in speed independently of each other.

Figure 3:
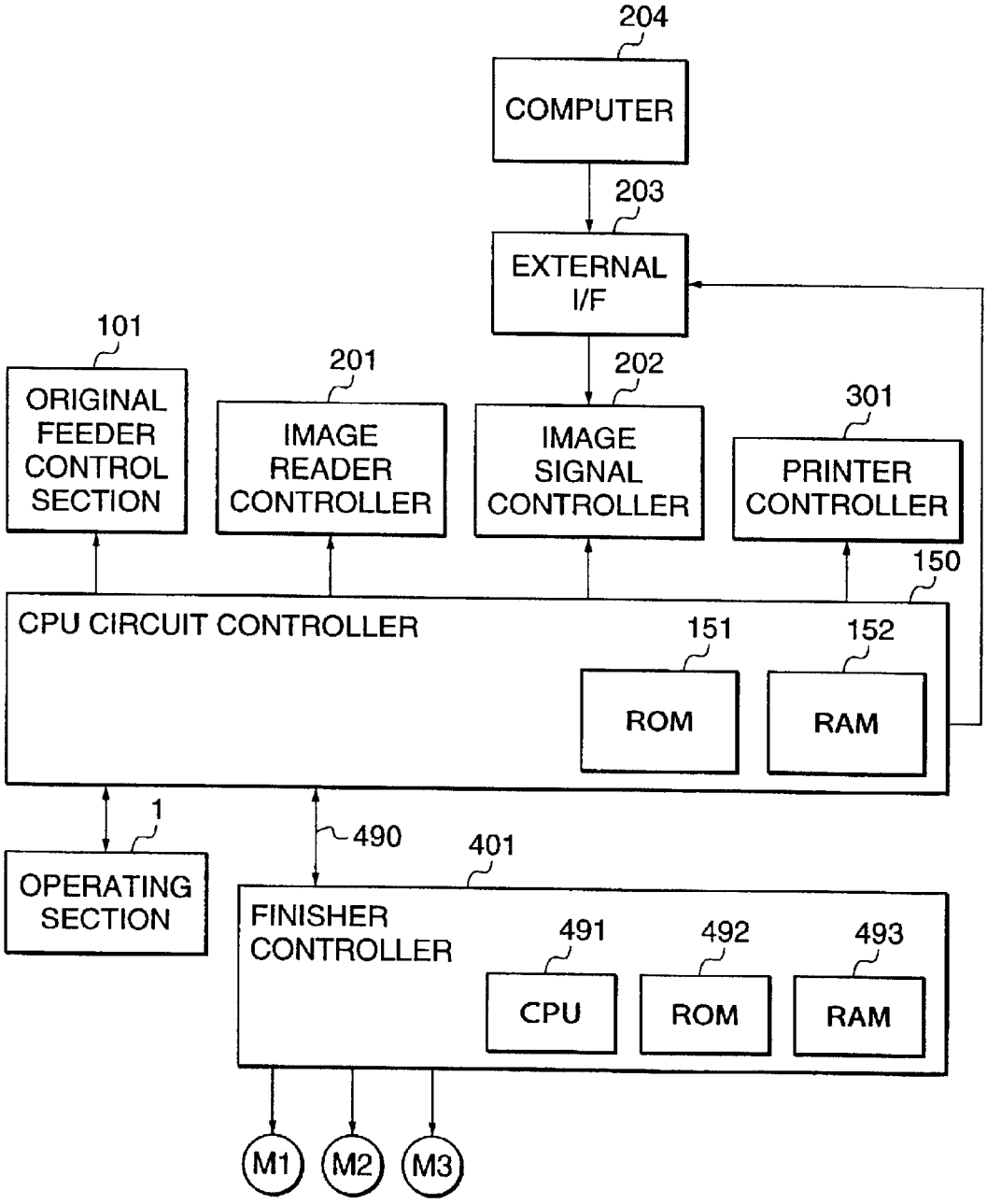
FIG. 3 is a block diagram showing essential parts related to control of the image forming apparatus.

FIG. 3 is a block diagram showing the arrangement of essential parts related to control of the image forming apparatus.

A CPU circuit controller 150 is comprised of a CPU, not shown, a ROM 151 that stores a control program and other programs, and a RAM 152 that functions as an area for temporarily holding control data and a work area for operations performed for control.

The CPU circuit controller 150 is connected to an operating section 1 that is operated by a user to make various settings, an image reader controller 201 that controls the image reader 200, an image signal controller 202 that controls the image signal, a printer controller 301 that controls the printer 300, an external I/F that provides interface for connecting to a computer 204, and a finisher controller 401 that is incorporated in the finisher 400 to control the finisher 400. The CPU circuit controller 150 carries out serial communication with the finisher controller 401 via a communication line 490. The finisher controller 401 receives a signal indicating that a sheet is to be discharged from the printer 300, information on the size of the sheet to be discharged, and a release signal, described later, from the CPU circuit controller 150 via the communication line 490. The CPU circuit controller 150 collectively controls the above-mentioned controllers according to the programs stored in the ROM 151 and the settings inputted through the operating section 1.

The finisher controller 401 includes a CPU 491, a ROM 492, a RAM 493, and others, and controls motors M1, M2, M3, and others. The RAM 493 is used as an area for temporarily holding control data and a work area for operations performed for control.

The external I/F 203 is an interface that expands print data outputted from the computer 204 into an image and outputs the same to the image signal controller 202. The image reader controller 201 outputs the image information read by the image sensor 109 to the image signal controller 202. Image information outputted from the image signal controller 202 to the printer controller 301 is inputted to the exposure controller 110.

Figure 4:
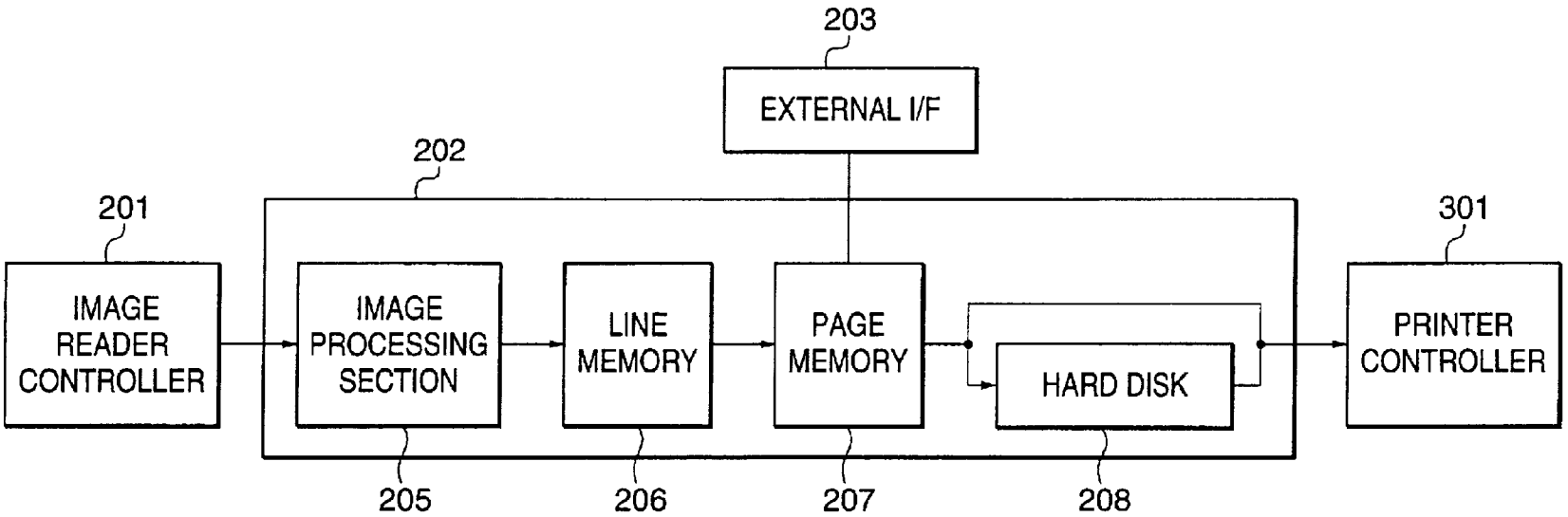
FIG. 4 is a block diagram showing the arrangement of an image signal controller 202 in FIG. 3.

FIG. 4 is a block diagram showing the arrangement of the image signal controller 202 in FIG. 3.

The image signal controller 202 is comprised of an image processing section 205, a line memory 206, a page memory 207, and a hard disk 208.

The image processing section 205 corrects the image information received from the image reader controller 201, and edits the image information according to settings inputted through the operating section 1. The resulting image information is outputted to the printer controller 301 via the line memory 206 and the page memory 207. The hard disk 208 is used to store data and for other purposes as the need arises as in the case where the order of pages is changed.

Figure 5:
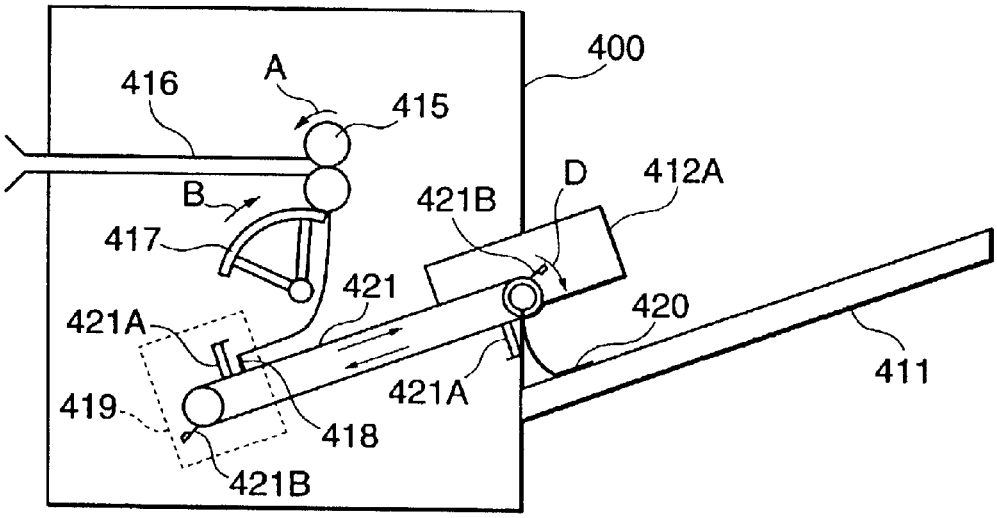
FIG. 5 is a schematic diagram showing the construction of a finisher 400 in FIG. 1.

FIG. 5 is a schematic diagram showing the construction of the finisher 400 in FIG. 1.

Figure 18:
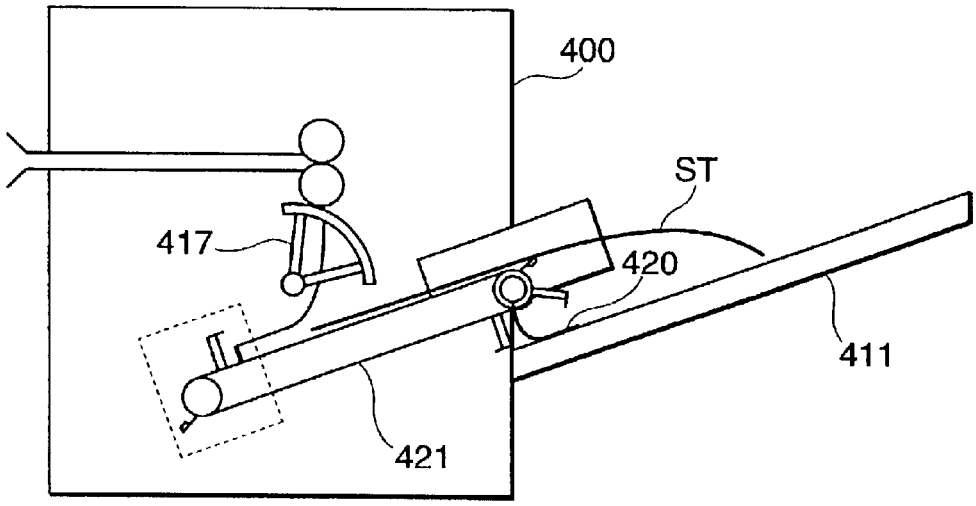
FIG. 18 is a view showing a state of a sheet in the finisher 400.

A path 416 is disposed in an upper part of the finisher 400 to guide a sheet discharged from the printer 300. A pair of discharge rollers 415 are disposed at the exit of the path 416. The discharge rollers 415 rotate in a direction indicated by an arrow A at a predetermined rotational speed to discharge the sheet in the path 416 toward a bundle discharge belt 421. A low-friction intermediate processing tray, not shown, is provided several millimeters above and in parallel with the bundle discharge belt 421, and the discharged sheet is received by the intermediate processing tray. The discharged sheet ST (refer to FIG. 18) falls along the intermediate processing tray which is inclined onto the bundle discharge belt 421.

A fan-shaped return roller 417 is disposed below the discharge rollers 415. A frictional member, not shown, is provided on an arc surface of the return roller 417. The return roller 417 rotates rightward as viewed in FIG. 5 (i.e. in a direction indicated by an arrow B) to cause the frictional member thereon to be brought into contact with the sheet discharged onto the bundle discharge belt 421 to move the sheet down to the left as viewed in FIG. 5 (i.e. in a direction toward a lower end of the bundle discharge belt 421 which is inclined).

Figure 19:
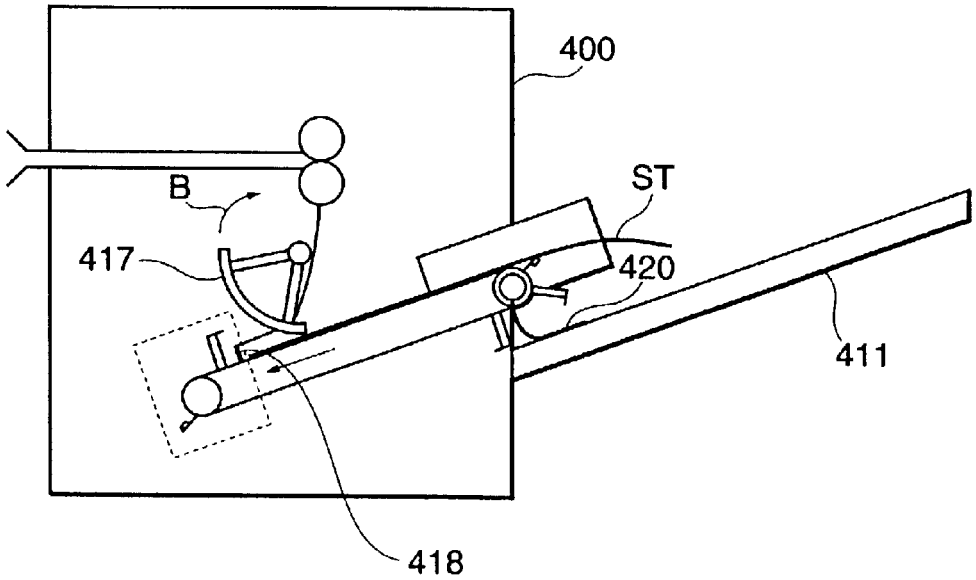
FIG. 19 is a view showing a sheet in a different state from the sheet in FIG. 18.

A stopper plate 418 is arranged at the lower end of the bundle discharge belt 421 to receive the sheet ST. An end of the sheet ST is brought into contact with the stopper plate 418 (refer to FIG. 19). A staple unit 419 is disposed in the vicinity of the lower end of the bundle discharge belt 421. The staple unit 419 is disposed on the front side as viewed in FIG. 5 to staple sheets stacked on the bundle discharge belt 421.

Since the length of the bundle discharge belt 421 may be too short to stack thereon sheets of a certain size, the bundle discharge belt 421 is provided with an intermediate tray auxiliary plate 421B that is used to support the stacked sheets. The intermediate processing tray auxiliary plate 421B provides an additional length to a sheet stacking surface of the intermediate processing tray. Alignment plates 412A, 412B are disposed in the vicinity of both lateral sides of the upper end of the bundle discharge belt 421 (refer to FIG. 8). The alignment plates 412A, 412B are used to align the sheets on the bundle discharge belt 421 in a transverse direction (perpendicular to the sheet conveying direction). Further, by changing the positions of the alignment plates 412A, 412B, the sheets ST can be stacked in a manner being offset from the center of the stack tray 411 (offset stacking).

Figure 21:
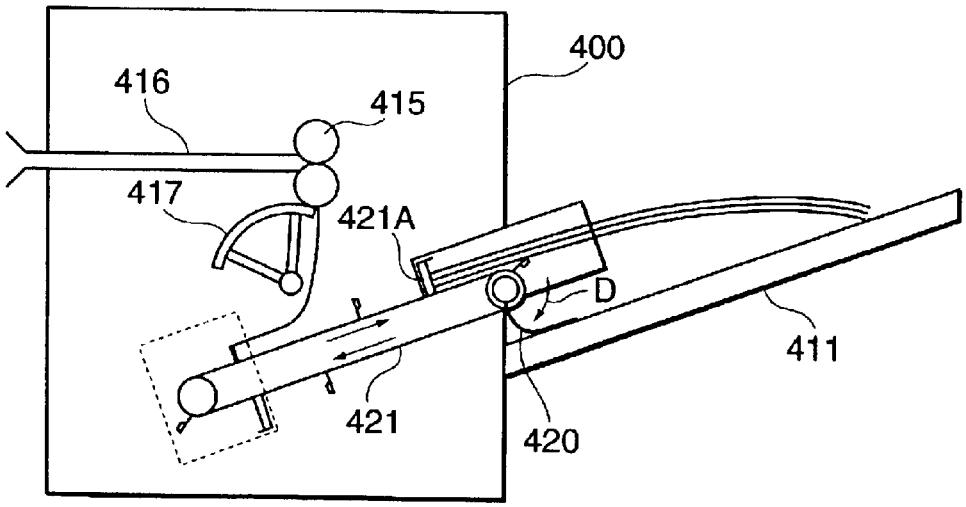
FIG. 21 is a view showing another state of the sheets in the finisher 400.

The bundle discharge belt 421 is provided with a bundle discharge lever 421A. The bundle discharge lever 421A rotates the bundle discharge belt 421 in a direction indicated by an arrow D to convey the sheet toward the upper end of the bundle discharge belt 421 and discharge the sheet onto the stack tray 411 (refer to FIG. 21). It should be noted that the intermediate processing tray is provided with an elongate slot extending parallel with a direction in which the bundle discharge belt 421 is extended, and the bundle discharge lever 421A is capable of moving in the slot.

The stack tray 411 moves up and down according to the amount of sheets stacked thereon. The upper side of a sheet discharged onto the stack tray 411 is pressed by a bundle sheet pressing member 420. Thereafter, the stack tray 411 is moved down by a predetermined amount, and is then moved up to cause the bundle sheet pressing member 420 to press the upper side of a sheet again. This prevents a sheet already stacked on the stack tray 411 from being pushed out toward the upper end of the stack tray 411 by a sheet discharged next onto the stack tray 411.

Figure 6:
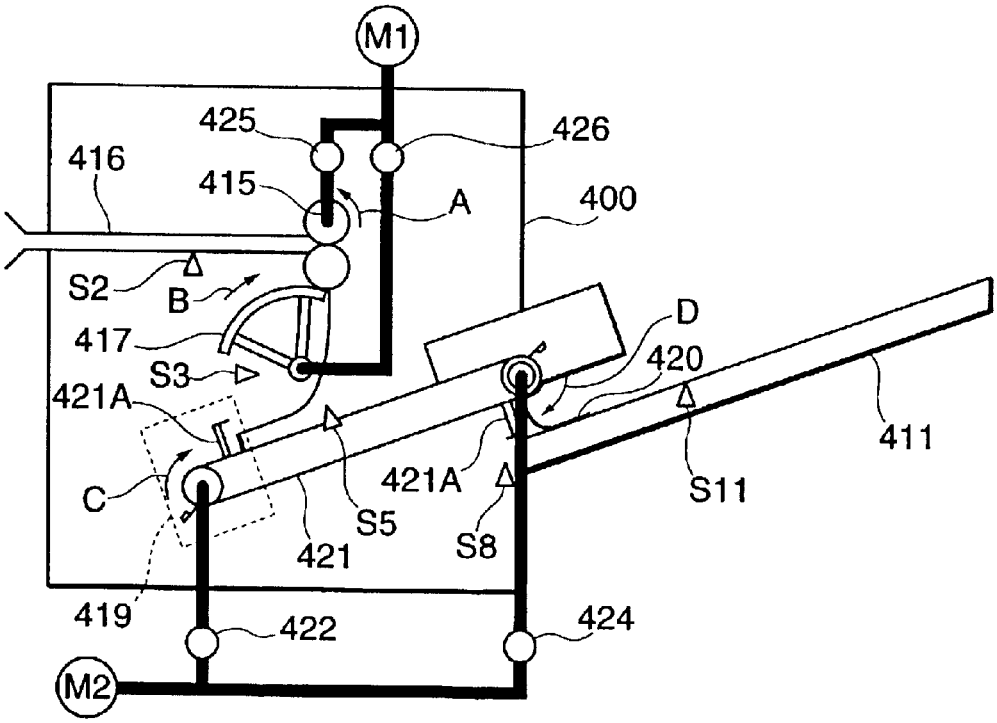
FIG. 6 is a schematic diagram showing the arrangement of sensors and motors in the finisher 400 in FIG. 1.

FIG. 6 is a view useful in explaining sensors and motors in the finisher 400 in FIG. 1.

The finisher 400 incorporates therein the motors M1, M2, and motors M3, M4, M5, described later. The motor M1 drives the discharge rollers 415 and the return roller 417, and the motor M2 drives the bundle sheet pressing member 420 and the bundle discharge belt 421.

The motor M1 drives the discharge rollers 415 via a one-way clutch 425, and drives the return roller 417 via a one-way clutch 426. When the motor M1 rotates forward, only the discharge rollers 415 rotate in the direction indicated by the arrow A to convey the sheet. When the motor M1 rotates backward, only the return roller 417 rotates in the direction indicated by the arrow B.

The motor M2 drives the bundle discharge belt 421 via a one-way clutch 422, and drives the bundle sheet pressing member 420 via a one-way clutch 424. When the motor M2 rotates forward, only the bundle sheet pressing member 420 rotates in a direction indicated by an arrow C. When the motor M2 rotates backward, only the bundle sheet pressing member 420 rotates in the direction indicated by the arrow D. Driving both the discharge rollers 415 and the return roller 417 by one motor and driving both the bundle discharge belt 421 and the bundle sheet pressing member 420 by one motor reduces the cost.

A flag, not shown, is mounted on a rotary shaft of the return roller 417. A sensor S3 is disposed in the vicinity of the return roller 417, and detects whether the return roller 417 is located at a home position thereof or not. The position of the return roller 417 shown in FIG. 6 is the home position.

A sensor S2 is disposed at the lower side of the bath 416 to detect the leading end of the sheet, and upon the detection, the discharge rollers 415 are activated. The discharge rollers 415 are slowed in timing described later and then stopped.

A sensor S5 is disposed in the vicinity of the bundle discharge belt 421 to detect a sheet on the bundle discharge belt 421. A sensor S11 is disposed in the vicinity of the stack tray 411 to detect a sheet on the stack tray 411. A sensor S8 is disposed in the vicinity of the lower end of the stack tray 411, and detects whether the bundle discharge lever 421A is located at a home position thereof or not. The position of the bundle discharge lever 421A shown in FIG. 6 is the home position. The home position of the bundle discharge lever 421A is located slightly upstream of the stopper plate 418 (refer to FIG. 5) in the conveying direction.

Every time one sheet is discharged, the return roller 417 makes one rotation from the home position in the direction indicated by the arrow B. While the return roller 417 is rotating in the direction indicated by the arrow B, the discharge rollers 415 remain unmoved as mentioned above.

To discharge a bundle of sheets, the bundle discharge belt 421 makes a half rotation, but nonstop half rotation of the bundle discharge belt 421 causes the bundle discharge lever 421A to be brought into contact with a bundle of sheets stacked on the stack tray 411. This is because the stack tray 411 is controlled to be positioned at a distance suitable for the bundle of sheets to fall when it is discharged, and at this position of the stack tray 411 the upper surface of the bundle of sheets stacked on the stack tray 411 is positioned on the moving path of the bundle discharge lever 421A.

Figure 7:
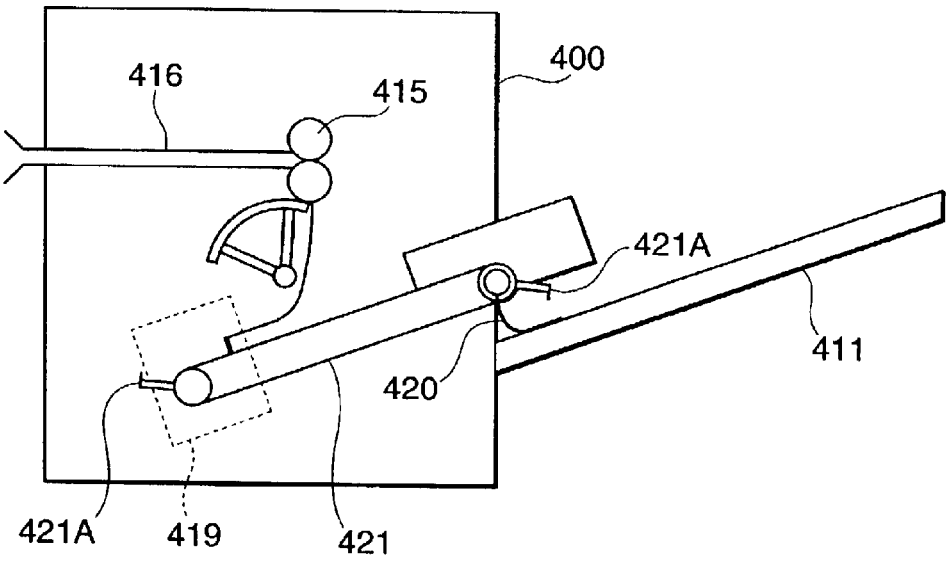
FIG. 7 is a view useful in explaining a position where a bundle discharge lever is temporarily stopped.

To address this problem, as shown in FIG. 7, the bundle discharge belt 421 is temporarily stopped when the bundle discharge lever 421A becomes substantially parallel with a linear part of the bundle discharge belt 421 (i.e. substantially parallel with the intermediate processing tray, not shown), and after the stack tray 411 has moved down, the bundle discharge belt 421 is restarted to rotate through the remaining angle, and then the bundle discharge lever 421A is stopped at the home position. This prevents the bundle discharge lever 421A from rolling in sheets from the stack tray 411, and prevents the trailing end of the sheet bundle from remaining on the bundle discharge belt 421.

Figure 8:
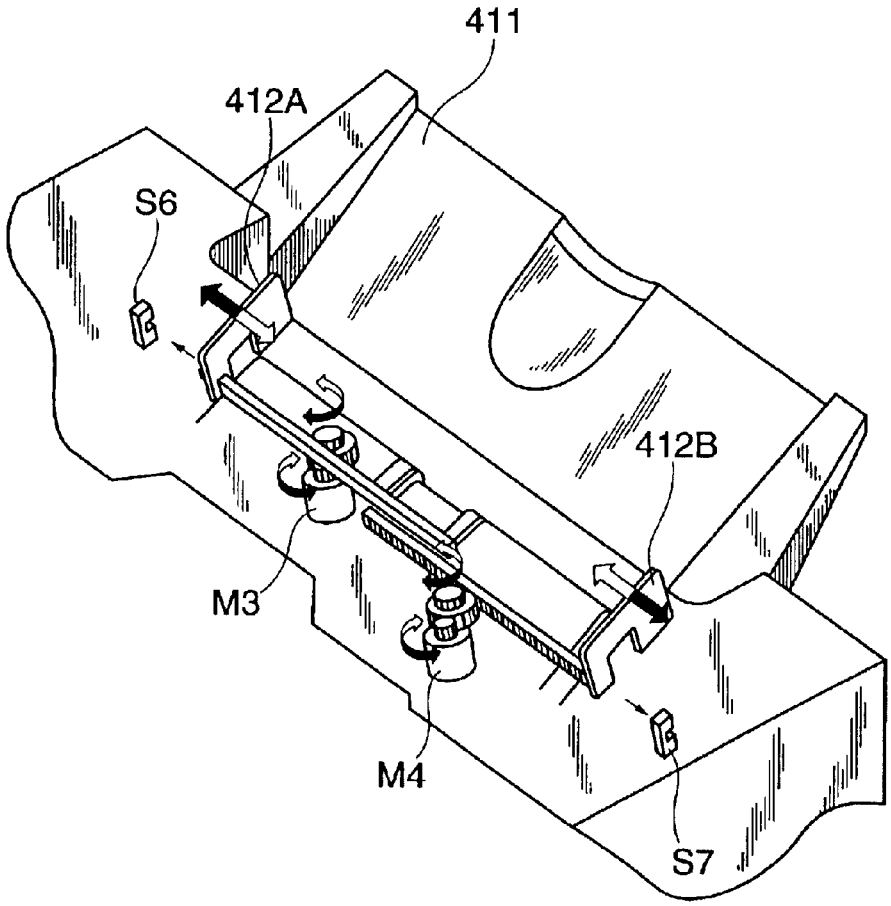
FIG. 8 is a perspective view showing a drive mechanism for alignment plates 412A, 412B and peripheral parts thereof.

FIG. 8 is a perspective view showing a drive mechanism for the alignment plates 412A, 412B, and peripheral parts thereof.

The alignment plates 412A, 412B are disposed above the stack tray 411 and upstream in the sheet discharge direction such that their plate surfaces are opposed to each other. The motor M3 drives the alignment plate 412A back and forth, and the motor M4 drives the alignment plate 412B back and forth. If the motors M3, M4 rotate in directions indicated by white arrows in FIG. 8, the alignment plates 412A, 412B move in such directions as to narrow the interval therebetween (i.e. in directions indicated by white arrows). On the other hand, if the motors M3, M4 rotate in directions indicated by black arrows in FIG. 8, the alignment plates 412A, 412B move in such directions as to widen the interval therebetween (i.e. in directions indicated by black arrows).

Figure 20:
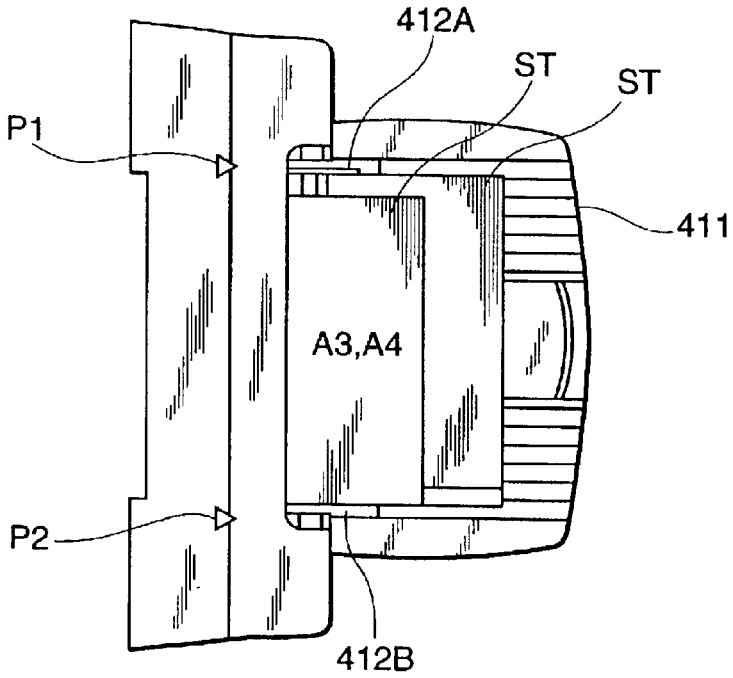
FIG. 20 is a plan view showing a peripheral part of the stack tray 411 to show a state of sheets in the finisher 400.

A sensor S6 is disposed in the vicinity of the alignment plate 412A. The sensor S6 is used to detect a home position P1 of the alignment plate 412A (refer to FIG. 20). A sensor S7 is disposed in the vicinity of the alignment plate 412B. The sensor S7 is used to detect a home position P2 of the alignment plate 412B (refer to FIG. 20).

When the staple unit 419 (refer to FIG. 7) staples a bundle of sheets, the alignment plate 412B is moved into an extreme position in the direction indicated by the black arrow, and every time a sheet is discharged onto the bundle discharge belt 421, the other alignment plate 412A moves back and forth so as to press the sheet against the alignment plate 412B.

To perform offset discharging (offset stacking) without stapling, the alignment plates 412A, 412B are set with an interval corresponding to the width of a sheet therebetween. Every time a sheet is discharged onto the bundle discharge belt 421, one of the alignment plates 412A, 412B is pressed against the sheet so that the sheet can be pressed against the other one of the alignment plates 412A, 412B. In the offset discharging, the pair of alignment plates 412A, 412B are moved back and forth in the same direction for each discharge of a bundle of sheets on the stack tray 411 in a state in which the bundles are offset from each other on the stack tray 411 (refer to FIG. 20).

It should be noted that the user can select whether the offset discharging is to be carried out or not by making a setting through the operating section 1. The image forming apparatus notifies the finisher 400 of the setting, and the finisher 400 operates in accordance with the setting.

A description will now be given of the timing in which the alignment plates 412A, 412B and the return roller 417 are driven. As described previously, the return roller 417 moves a sheet in the discharge direction, and the alignment plates 412A, 412B move a sheet in a direction perpendicular to the sheet discharge direction. Thus, the return roller 417 and the alignment plates 412A, 412B move a sheet in different directions. To prevent the actions of the return roller 417 and the alignment plates 412A, 412B from overlapping, the alignment plates 412A, 412B are controlled to be activated at a time point when the action of the return roller 412 has been completed.

Figure 9:
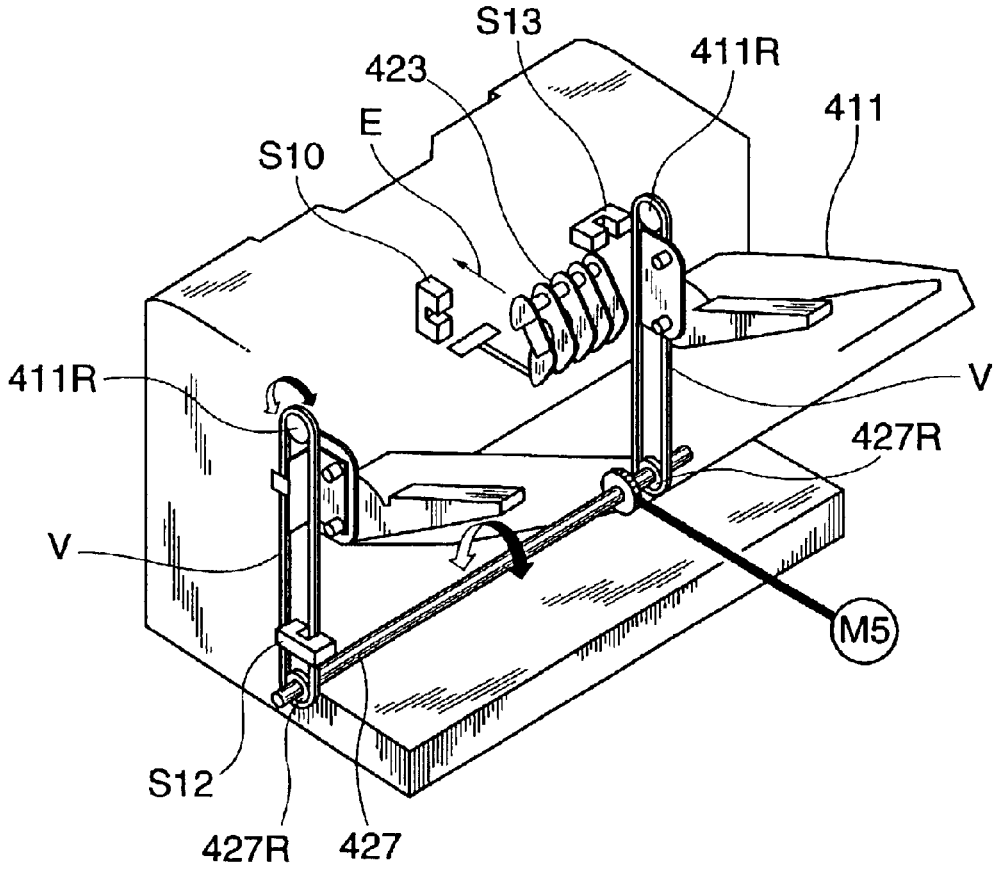
FIG. 9 is a perspective view showing a mechanism for moving up and down a stack tray 411 in FIG. 1 and peripheral parts thereof.

FIG. 9 is a perspective view showing a mechanism for moving up and down the stack tray 411 in FIG. 1 and peripheral parts thereof.

Rollers 411R, 411R are attached to the stack tray 411, and a shaft 427 is disposed at the lower side of the stack tray 411 to extend in a direction perpendicular to the sheet discharge direction. Rollers 427R, 427R are fixed at locations right below the rollers 411R, 411R. A belt V is extended around the roller 411R and the roller 427R. The shaft 427 is connected to the motor M5, and the motor M5 rotates the shaft 427 about its own axis.

When the motor M5 rotates the shaft 427 in a direction indicated by a black arrow in FIG. 9, the belt V rotates in a direction indicated by a black arrow. When the motor M5 rotates the shaft 427 in a direction indicated by a white arrow, the belt V rotates in a direction indicated by a white arrow. This causes the stack tray 411 to move up and down.

A sensor S13 is provided to detect whether the stack tray 411 has reached an upper limit position thereof, and a sensor S12 is provided to detect whether the stack tray 411 has reached a lower limit position thereof. A flag 423 is arranged at such a location as to be pressed by sheets stacked on the stack tray 411. The flag 423 is pressed upstream (indicated by an arrow E) in the sheet discharge direction by the sheets. A sensor S10 detects the pressed flag 423, so that the height of the sheets stacked on the stack tray 411 can be detected.

In a bundle discharge mode where sheets are discharged in a bundle, the stack tray 411 moves down to prevent the bundle discharge lever 421A from contacting the stack tray 411. The stack tray 411 moves down to such a position as not to be detected by the sensor S10. After moving down to this position, the stack tray 411 is moved up to enable the top surface of a newly discharged bundle of sheets to be moved to the next bundle discharge position. Before the downward movement of the stack tray 411 after the discharge of the bundle, the bundle sheet pressing member 420 is rotated in the direction indicated by the arrow D (refer to FIG. 6) to press the sheets on the stack tray 411.

Figure 10:
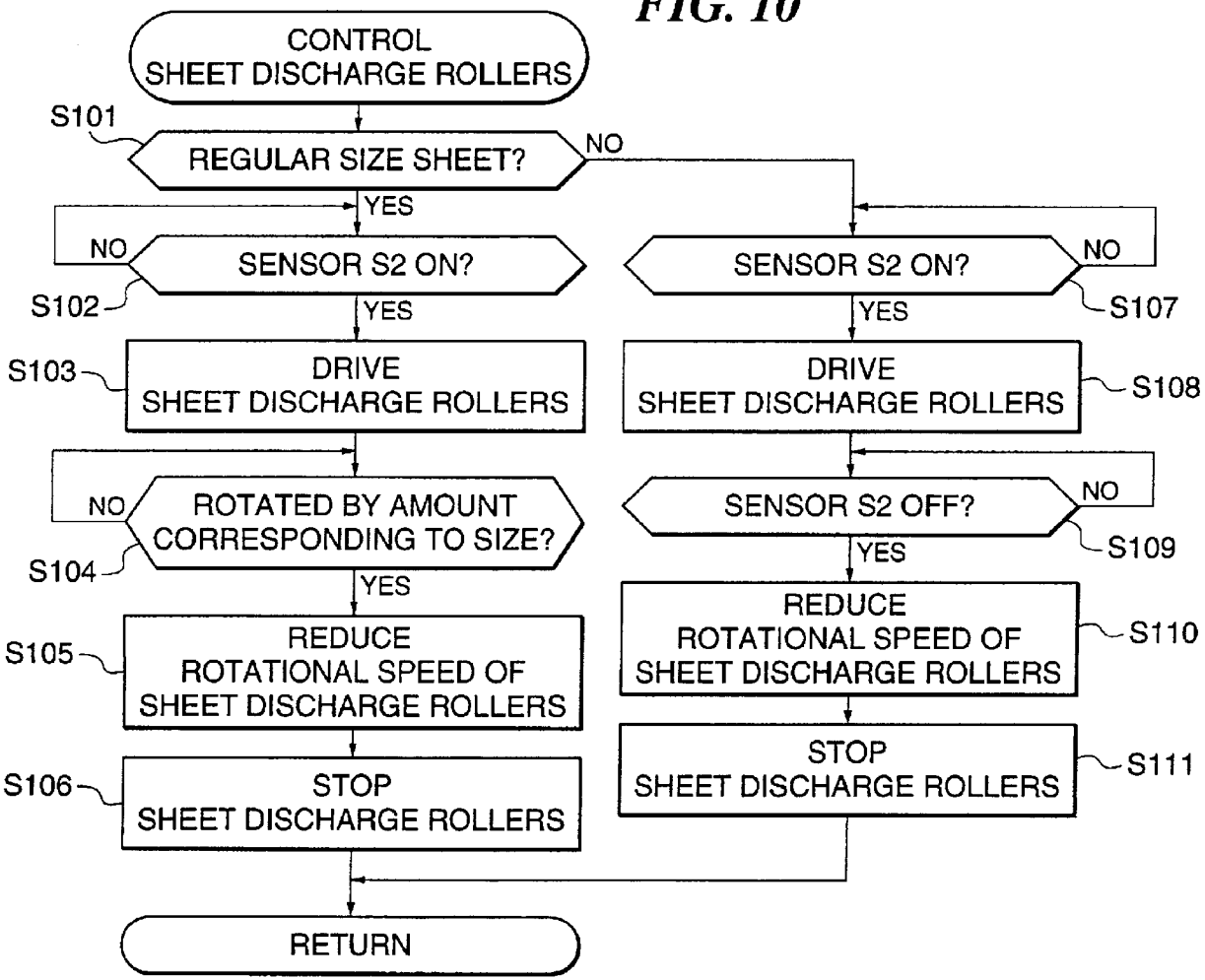
FIG. 10 is a flow chart showing the procedure for driving a discharge roller in the finisher 400 in FIG. 6.

FIG. 10 is a flow chart showing the procedure for providing control to drive the sheet discharge rollers 415 in the finisher 400 in FIG. 6.

To reduce the size of the finisher 400, there is the necessity of reducing the length of the path 416 (refer to FIG. 6). Reducing the length of the path 416 shortens the distance between the sheet discharge rollers 415 and the sensor S2. On the other hand, if the stackability in discharging sheets onto the bundle discharge belt 421 from the sheet discharge rollers 415 is taken into consideration, it is preferable that a sheet is conveyed at a high speed by rotating the sheet discharge rollers 415 at a high speed, and the rotational speed of the sheet discharger rollers 415 is reduced just before the trailing end of the sheet is released from the sheet discharge rollers 415 so as to prevent the sheet from jumping over the bundle discharge belt 421. In the case where the rotational speed of the sheet discharge rollers 415 is reduced based on the position of the trailing end of a sheet, the rotational speed of the sheet discharge rollers 415 is usually reduced in response to detection of the trailing end of the sheet. If the distance between the sheet discharge rollers 415 and the sensor S2 is short as mentioned above, however, the stackability may not be satisfactorily improved even if the sheet can be prevented from jumping over the bundle discharge belt 421. Therefore, the following control is provided in order to improve the stackability while reducing the size of the finisher 400.

The finisher controller 401 of the finisher 400 receives information on the size of each sheet from the image forming apparatus (CPU circuit controller 150). First, the finisher controller 401 determines whether a sheet to be discharged by the sheet discharge rollers 415 is a regular size sheet or not (step S101). If it is determined in the step S101 that the sheet is the regular size sheet, the finisher controller 401 determines whether the sensor S2 is on or not (step S102). If the sensor S2 is on, this means that the leading end of the sheet has passed a detection range of the sensor S2. If it is determined in the step S102 that the sensor is not on, the finisher controller 401 waits until the sensor S2 is turned on. If it is determined in the step S102 that the sensor S2 is on, the finisher controller 401 starts the motor M1 to drive the sheet discharge rollers 415 (step S103). The motor M1 is a step motor, whose torque is constantly controlled by the finisher controller 401.

The finisher controller 401 then determines whether the sheet discharge rollers 415 have rotated by an amount corresponding to the size of the sheet (step S104). This determination is made based on whether a predetermined period of time set for each sheet size has elapsed. If it is determined in the step S104 that the sheet discharge rollers 415 have not rotated by the amount corresponding to the size of the sheet, the finisher controller 401 waits until the sheet discharge rollers 415 completes its rotation by the amount corresponding to the size of the sheet. If it is determined in the step S104 that the sheet discharge rollers 415 have rotated by the amount corresponding to the size of the sheet, the finisher controller 401 reduces the rotational speed of the sheet discharge rollers 415 (step S105) and then stop them (step S106). The predetermined period of time required for waiting in the step S104 is determined by taking into consideration the size of the sheet and a period of time required for reducing the rotational speed of the sheet discharge rollers 415, so that the trailing end of the sheet can be released from the sheet discharger rollers 415 just before they are stopped in the step S106.

On the other hand, if it is determined in the step S101 that the sheet is not the regular size sheet, that is, the sheet is a free-size sheet, the finisher controller 401 determines whether the sensor S2 is on or not (step S107). If it is determined in the step S107 that the sensor S2 is not on, the finisher controller 401 waits until the sensor S2 is turned on. If it is determined in the step S107 that the sensor S2 is on, the finisher controller 401 starts the motor M1 to drive the sheet discharge rollers 415 (step S108).

The finisher controller 401 then determines whether the sensor S2 is off or not (step S109). If the sensor S2 is off, this means that the trailing end of the sheet has passed the detection range of the sensor S2. If it is determined in the step S109 that the sensor is not off, the finisher controller 401 waits until the sensor S2 is turned off. If it is determined in the step S109 that the sensor is off, the finisher controller 401 reduces the rotational speed of the motor M1 to reduce the rotational speed of the sheet discharge rollers 415 (step S110), and then stops them (step S111).

The above-described processing prevents the discharged sheet from jumping over the bundle discharge belt 421.

Figure 11:
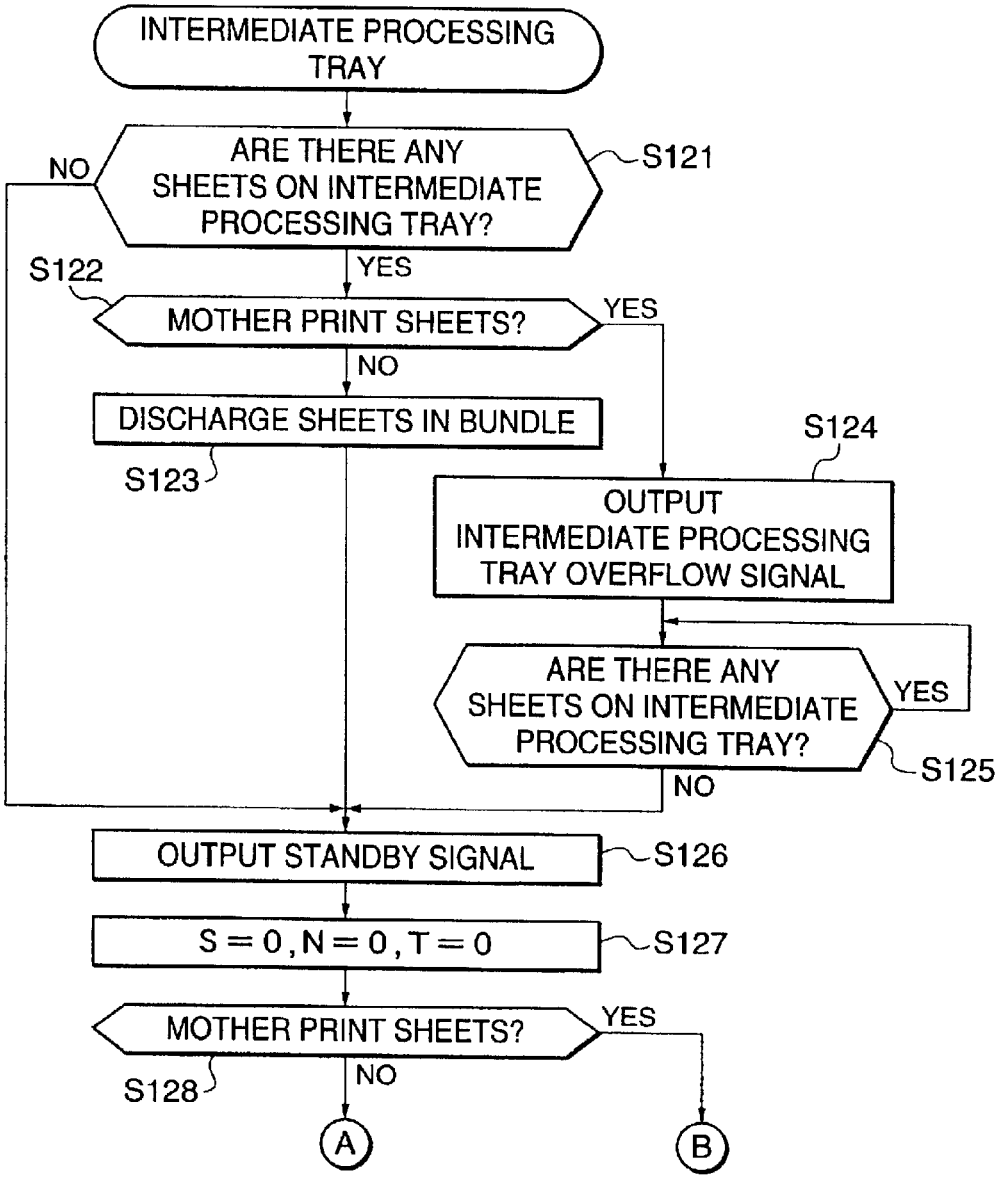
FIG. 11 is a flow chart showing a part of the procedure for controlling discharge of a bundle sheet by a bundle discharge belt 421 in FIG. 6.
Figure 12:
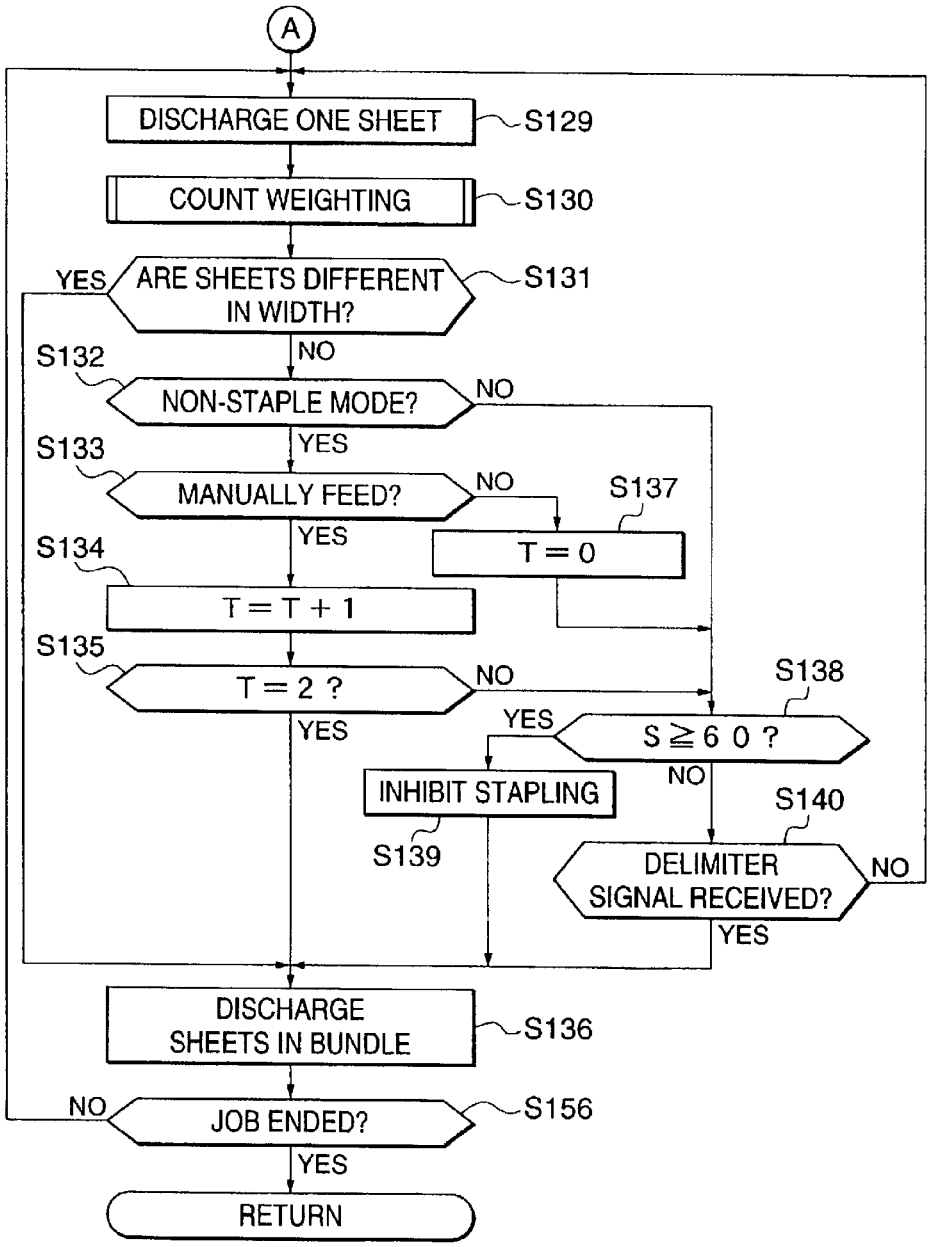
FIG. 12 is a flow chart showing a continued part of the procedure in FIG. 11.
Figure 13:
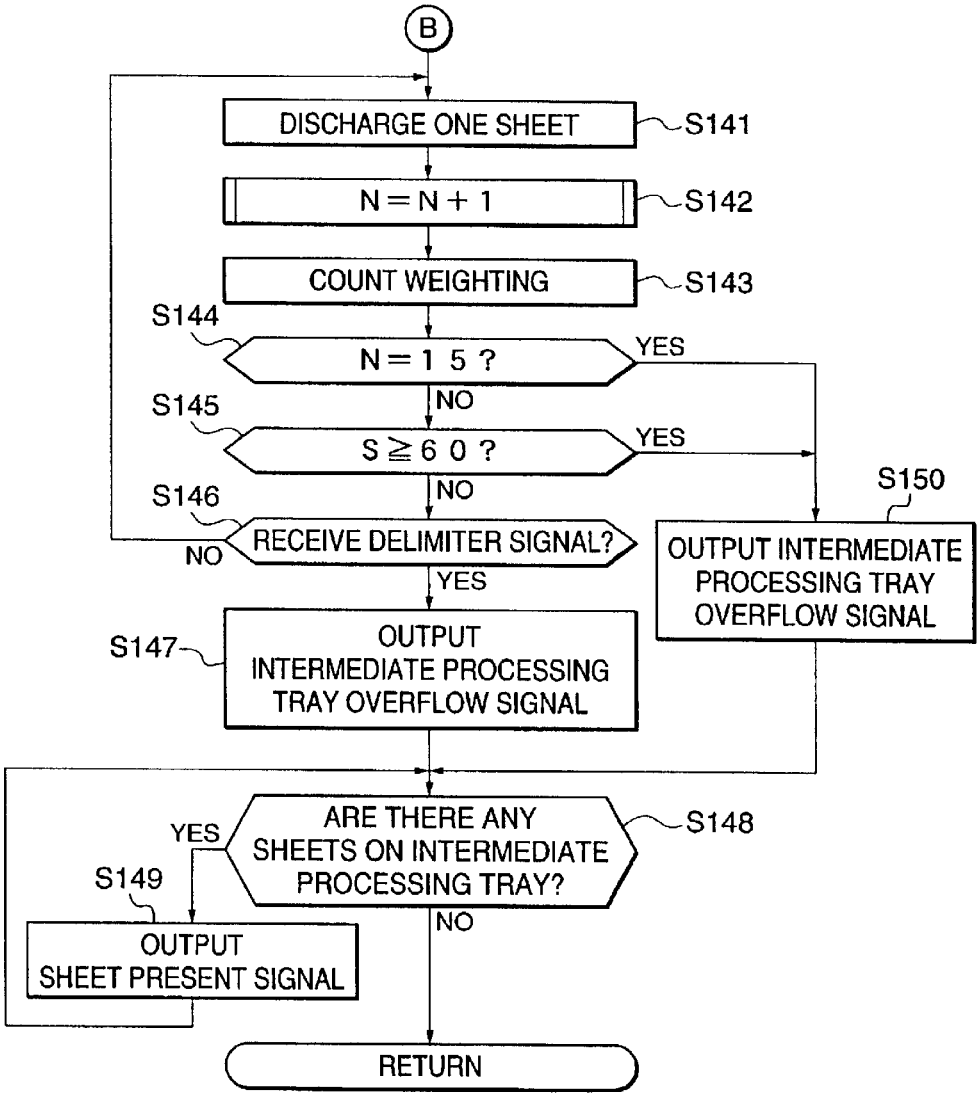
FIG. 13 is a flow chart showing another continued part of the procedure in FIG. 11.

FIGS. 11 to 13 are flow charts showing a part of the process for controlling discharge of a bundle of sheets by the bundle discharge belt 421 in FIG. 6.

First, as an initial step before image formation, the sensor S5 determines whether there are any sheets or not on the bundle discharge belt 421 (intermediate processing tray) (step S121). If it is determined in the step S121 that there are any sheets on the bundle discharge belt 421, the finisher 400 determines whether the sheets are mother print sheets or not (step S122). The mother print sheets are thin and inelastic sheets used for drawing, for example.

Whether the sheets are the mother print sheet or not is determined in the following manner. An instruction for using the manual sheet feed section 125 (refer to FIG. 1) is inputted to the image forming apparatus, and a mother print key is selected on a screen of the operating section 1 of the image forming apparatus (refer to FIG. 3), it is assumed that the mother print sheet is fed from the manual sheet feed section 125. When the sheets are conveyed from the image forming apparatus to the finisher 400, the image forming apparatus supplies the finisher 400 with material information and sheet feed section information corresponding to the sheets. This enables the finisher 400 to determine whether the sheets on the bundle discharge belt 421 are the mother print sheets or not.

If it is determined in the step S122 that the sheets are not the mother print sheets, the bundle discharge belt 421 is driven to discharge the sheets in a bundle (step S123), and the finisher 400 outputs a standby signal to the image forming apparatus (step S126). If it is determined in the step S122 that the sheets are the mother print sheets, the finisher 400 outputs an intermediate processing tray overflow signal to the image forming apparatus (step S124).

The image forming apparatus having received the intermediate processing tray overflow signal displays a message that "Remove sheets from the intermediate processing tray." on the operating section 1. It is then determined whether there are any sheets on the bundle discharge belt 421 (intermediate processing tray) or not (step S125). If it is determined that there are any sheets on the bundle discharge belt 421, the finisher 400 waits until the sheets are removed (step S125). If it is determined that there is no sheet on the bundle discharge belt 421 ("NO" in the step S125), the finisher 400 outputs the standby signal to the image forming apparatus (step S126). If it is determined in the step S121 that there is no sheet on the intermediate processing tray, the finisher 400 also outputs the standby signal to the image forming apparatus (step S126). In response to the standby signal from the finisher 400, the image forming apparatus starts forming an image on the sheet.

After outputting the standby signal in the step S126, each of variables S, N, and T is set to 0 (step S127). The variables S and N are used to check whether an excessive amount of sheets are stacked on the intermediate processing tray. The variable T is mainly used to prevent static electricity on OHP sheets from exerting adverse effects on OHP sheets on the stack tray 411 in the case where OHP sheets are discharged.

The finisher 400 then receives the material information from the image forming apparatus to determine whether the sheets are the mother print sheets or not (step S128).

If it is determined in the step S128 that the sheets are not the mother print sheets ("NO" in the step S128), the following process is carried out. One sheet received from the image forming apparatus is discharged onto the bundle discharge belt 421 (step S129), and count weighting is performed on the variable S, as described later (step S130). Then, the finisher controller 401 receives the information on the size of a sheet to be received next from the image forming apparatus, and determines whether the width of the sheets already stacked on the bundle discharge belt 421 and the width of the sheet to be received next are different from each other or not (step S131).

If it is determined that the width of the sheets already stacked on the bundle discharge belt and the width of the sheet to be received next are not different from each other ("NO" in the step S131), it is determined whether a mode set for an image formation job with respect to the sheet being currently received is a non-staple mode or not (step S132).

If it is determined that the mode is the non-staple mode ("YES" in the step S132), it is determined whether the sheet discharged onto the bundle discharge belt 421 in the step S129 is one fed from the manual sheet feed section 125 or not (step S133). If it is determined that the sheet is one fed from the manual sheet feed section 125 ("YES" in the step S133), 1 is added to the variable T (step S134), and it is determined whether the variable T is 2 or not (step S135).

If it is determined that the variable T is 2 ("YES" in the step S135), that is, when two sheets have been continuously fed from the manual sheet feed section 125, the bundle discharge belt 421 is driven to discharge the sheets in a bundle (step S136). It is then determined whether the job has been completed or not (step S156). If it is determined that the job has not been completed ("NO" in the step S156), the process returns to the step S129. On the other hand, if the sheet is not one fed from the manual sheet feed section 125 ("NO" in the step S133), the variable T is set to 0 (step S137), and the process proceeds to a step S138, described later. If it is determined in the step S135 that the variable T is not 2, the process also proceeds to the step S138.

The manual sheet feed section 125 is designed to be capable of feeding various types of sheets such as OHP sheets. The OHP sheets are easily charged with static electricity compared with ordinary plain sheets. Even if thirty plain sheets are discharged in a bundle from the bundle discharge belt 421 onto the stack tray 411, they do not exert adverse effects on sheets on the stack tray 411. If thirty OHP sheets are discharged in a bundle, however, there is the possibility that sheets already stacked on the stack tray 411 may be displaced due to the synergistic effect of weight and static electricity of the OHP sheets. Therefore, if two sheets are continuously fed from the manual sheet feed section 125 from which OHP sheets may be fed, the sheets are discharged in a bundle so as to prevent sheets stacked on the stack tray 411 from being displaced.

If it is determined in the step S131 that the width of the sheets already stacked on the bundle discharge belt 421 and the width of the sheet to be received next are different from each other, the process proceeds to the step S136 to discharge the sheets in a bundle. If it is determined in the step S132 that the mode is not the non-staple mode, that is, the mode is a staple mode, it is determined whether the variable S is not smaller than 60 (step S138).

If it is determined in the step S138 that the variable S is smaller than 60, it is determined whether a job delimiter signal has been received from the image forming apparatus or not (step S140), to thereby determine whether one job has been completed. If it is determined in the step S140 that the job delimiter signal has been received from the image forming apparatus, that is, the beginning or end of a job is indicated, the process proceeds to the step S136 to discharge the sheets in a bundle.

If it is determined in the step S138 that the variable S is not smaller than 60, the sheets are inhibited from being stapled at present (step S139), and the process then proceeds to the step S136 to discharge the sheets in a bundle. The inhibition of stapling is canceled after the job delimiter signal is accepted.

On the other hand, if it is determined in the step S128 that the sheets are the mother print sheets (refer to FIG. 11), one sheet received from the image forming apparatus is discharged onto the bundle discharge belt 421 (step S141), and 1 is added to the variable N (step S142). Count weighting is then performed on the variable S (step S143). It is then determined whether the variable N is 15 or not (step S144). If it is determined in the step S144 that the variable N is 15, it is determined whether the variable S is not smaller than 60 (step S145). If it is determined in the step S145 that the variable S is smaller than 60, it is determined whether the job delimiter signal has been received from the image forming apparatus or not (step S146) to determine whether the job has been completed. If it is determined in the step S146 that the delimiter signal has not been received from the image forming apparatus, the process returns to the step S141. If it is determined that the job has been completed ("YES" in the step S146), the finisher 400 outputs the intermediate processing tray overflow signal to the image forming apparatus (step S147). In response to the signal, the image forming apparatus displays the instruction asking the user to remove the sheets from the intermediate processing tray as mentioned above.

Since the mother print sheets are inelastic and are difficult to be discharged in a bundle, an instruction asking the user to remove the mother print sheets from the intermediate processing tray is displayed without discharging them in a bundle. On this occasion, the intermediate processing tray overflow signal is used as a signal that causes the image forming apparatus to display the instruction.

After the step S147, it is determined whether there are any sheets on the bundle discharge belt 421 (intermediate processing tray) or not (step S148). If it is determined in the step S148 that there are any sheets on the bundle discharge belt 421, that is, the sheets have not been removed irrespective of the above-mentioned instruction, a sheet presence signal indicating that there are any sheets on the intermediate processing tray is outputted to the image forming apparatus (step S149). The process then returns to the step S148. The image forming apparatus does not start the next image forming job while receiving the intermediate processing tray overflow signal and the sheet presence signal.

If it is determined in the step S144 that the variable N is 15 and it is determined in the step S145 that the variable S is not smaller than 60, it is determined that the amount of sheets stacked on the intermediate processing tray has reached the limit and the intermediate processing tray overflow signal is outputted to the image forming apparatus (step S150). The process then proceeds to the step S148. On this occasion, the image forming apparatus displays the instruction asking the user to remove the sheets from the intermediate processing tray.

Figure 22:
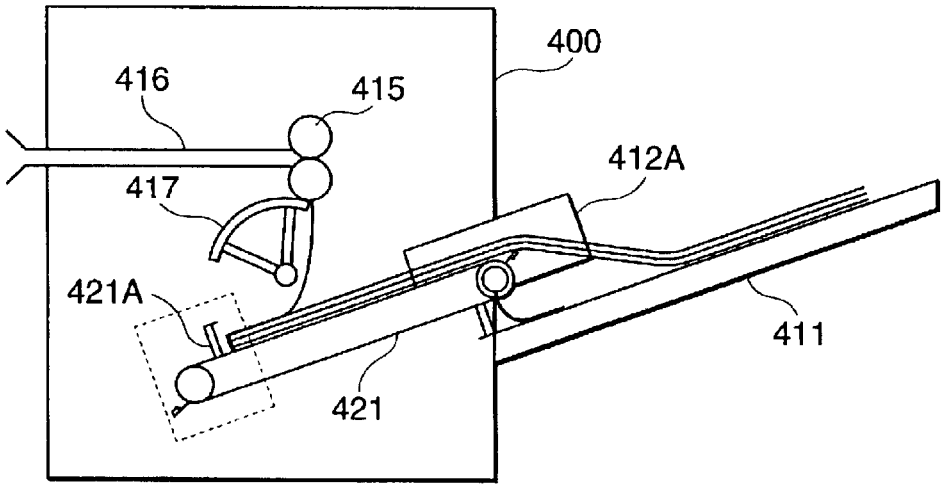
FIG. 22 is a view showing still another state of the sheets in the finisher 400.

It should be noted that in the case where the process proceeds to step S129 or subsequent steps (i.e. the sheets are not the mother print sheets), the alignment plates 412A, 412B are operated to carry out sheet alignment according to the size of the sheets, and the return roller 417 is rotated in the direction indicated by the arrow B (refer to FIG. 6). In the case where the process proceeds to the step S141 or subsequent steps (i.e. the sheets are the mother print sheets), the alignment plates 412A, 412B are receded to such positions as not obstruct the stacking of sheets without being operated for sheet alignment, and the return roller 417 is not driven. Note that FIG. 22 shows the state of the mother print sheets on the bundle discharge belt 421 when they are discharged.

Figure 14:
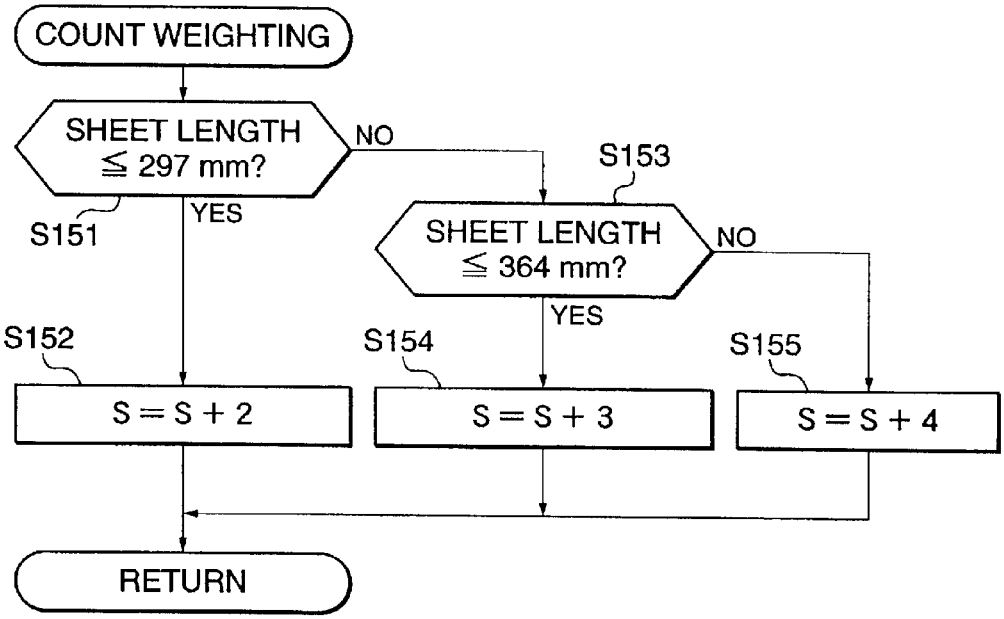
FIG. 14 is a flow chart showing the procedure for performing count weighting in a step S130 in FIG. 12 and a step S142 in FIG. 13.

FIG. 14 is a flow chart showing the procedure for performing the count weighting in the step S130 of FIG. 12 and in the step S143 of FIG. 13.

According to the information on the size of each sheet received from the image forming apparatus, it is determined whether the sheet length (the size in the conveying direction) is not greater than 297 mm (step S151). If it is determined in the step S151 that the sheet length is not greater than 297 mm, 2 is added to the variable S (step S152). If it is determined that the sheet length is greater than 297 mm ("NO" in the step S151) and equal to or smaller than 364 mm ("YES" in a step S153), 3 is added to the variable S (step S154). If the sheet length is greater than 364 mm ("NO" in the step S153), 4 is added to the variable S (step S155). By performing count weighting according to the sheet length, the maximum number of sheets suitable for being discharged in a bundle can be stacked on the intermediate processing tray. If the sheets are not discharged in a bundle, the sheets may be stacked to such an extent that the sheets are not scattered on the intermediate processing tray.

Figure 15:
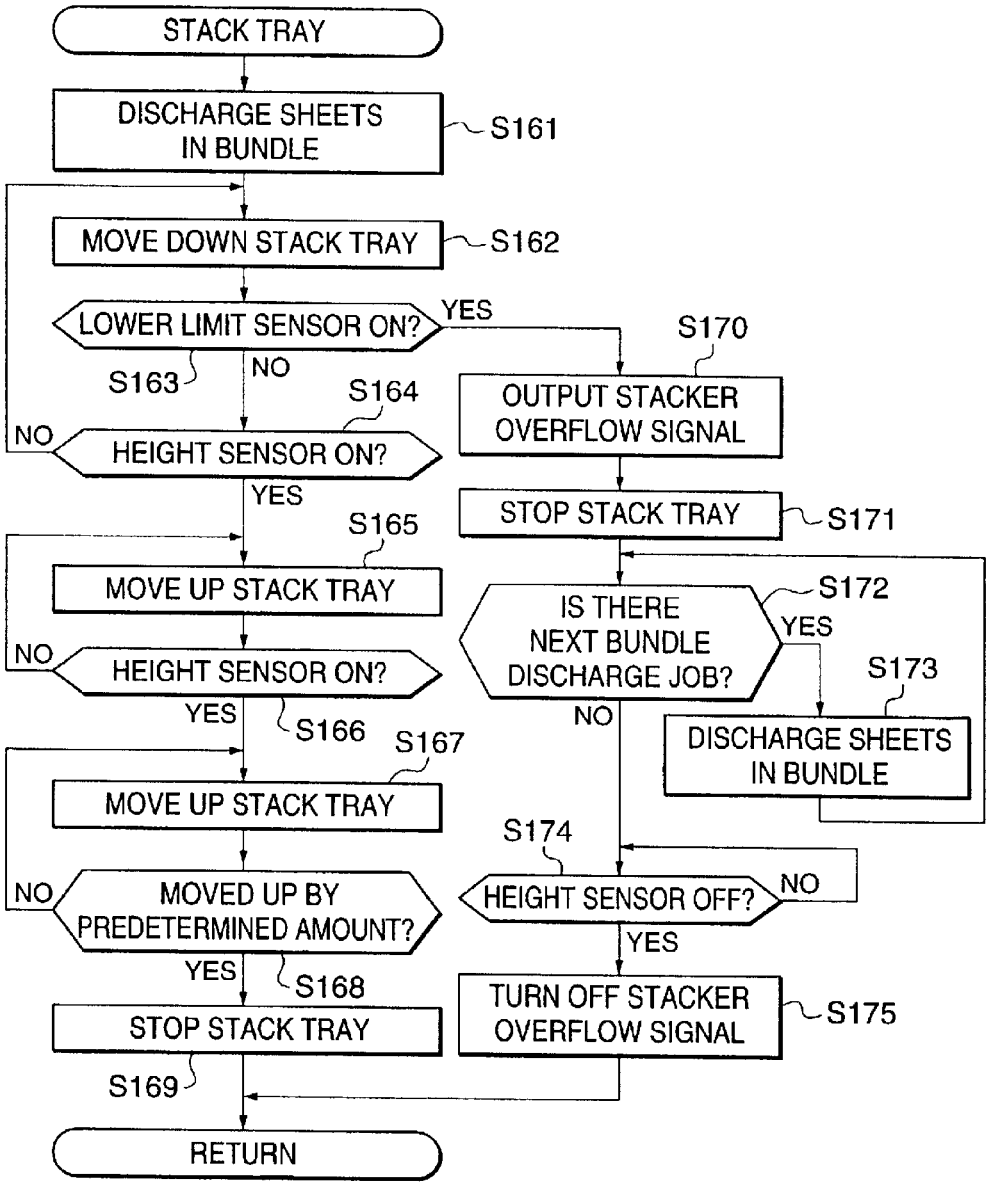
FIG. 15 is a flow chart showing the procedure for controlling the stack tray 411 by the finisher 400.

FIG. 15 is a flow chart showing the procedure for controlling the stack tray 411 in the finisher 400.

After the image forming apparatus starts copying (image formation), the stack tray 411 is controlled such that the sensor S10 is turned on to detect the height of sheets on the stack tray 411.

Sheets received from the printer 300 are discharged in a bundle by rotating the motor M2 (refer to FIG. 6) forward to drive the bundle discharge belt 421. The motor M2 is then rotated backward to rotate the bundle sheet pressing member 420 to carry out a bundle sheet discharging process (step S162) in which the sheets on the stack tray 411 are pressed. The stack tray 411 is then moved down (step S162), and it is determined whether the stack tray 411 has reached the lower limit position or not. This determination is made by determining whether a lower limit sensor S12 (refer to FIG. 9) has detected the stack tray 411 and accordingly has been turned on or not (step S163).

Figure 16:
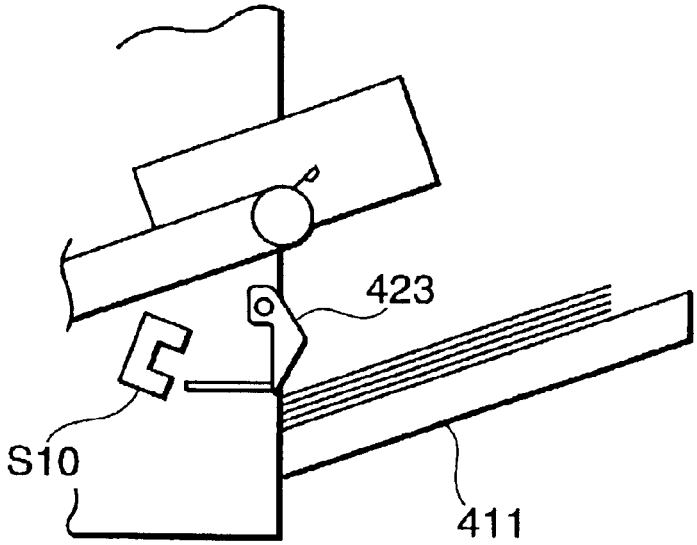
FIG. 16 is a view useful in explaining a state of a height sensor S10 and a flag 423.

If it is determined in the step S163 that the stack tray 411 has not reached the lower limit position, i.e. the lower limit sensor S12 has not been turned on since it has not detected the stack tray 411, it is then determined whether the height sensor S10 (refer to FIG. 16) is off or not (step S164). If it is determined that the height sensor S10 is not off ("NO" in the step S164), the process returns to the step S162.

Figure 17:
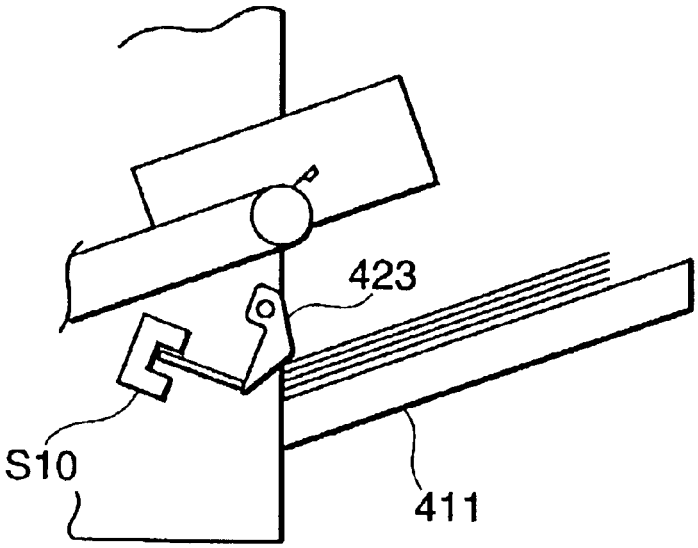
FIG. 17 is a view useful in explaining a flag in a different state from the flag 423 in FIG. 16.

If it is determined in the step S164 that the height sensor S10 is off, the stack tray 411 is stopped. If a predetermined period of time has elapsed, the stack tray 411 is moved up until the height sensor S10 is turned on (refer to FIG. 17) (steps S165 and S166). If the height sensor S10 is turned on ("YES" in the step S166), the stack tray 411 is moved up until the upward movement of the stack tray 411 reaches a predetermined amount (steps S167 and S168). If the upward movement of the stack tray 411 has reached the predetermined amount ("YES" in the step S168), the stack tray 411 is stopped (step S169). It should be noted that the motor M5 which moves up and down the stack tray 411 is a dynamotor, and the finisher controller 401 can check the upward and downward movement amount of the stack tray 411 by receiving the number of pulses from an encoder provided on a shaft of the dynamotor M5. The motor M5 is implemented by a stepping motor, and thus, the finisher controller 401 may also check the upward and downward movement amount of the stack tray 411 from input clocks to the motor.

If it is determined in the step S163 that the lower limit sensor S12 is on, i.e. the stack tray 411 has reached the lower limit position, a stacker overflow signal is outputted to the image forming apparatus (step S170) to stop the movement of the stack tray 411 (step S171). The image forming apparatus having received the stacker overflow signal displays a message "Remove sheets from the stack tray" on the operating section 1 after ending the job, thus asking the user to remove the sheets from the stack tray 411.

It is then determined whether there is the next job of discharging sheets in a bundle (step S172). If there is the next job ("YES" in the step S172), sheets are again discharged in a bundle (step S173). If it is determined in the step S172 that there is not the next job, the finisher 400 waits until the height sensor S10 is turned off (step S174). If the height sensor S10 has been turned off ("YES" in the step S174), the stacker overflow signal is turned off (step S175).

As described above, if the stack tray 411 has reached the lower limit position, several bundles of sheets corresponding to a job (e.g. a job received from the computer 204) that cannot be canceled at a time point when the stack tray 411 is detected to be at the lower limit position are discharged without moving up the stack tray 411 in the steps S165 and S167.

Figure 23:
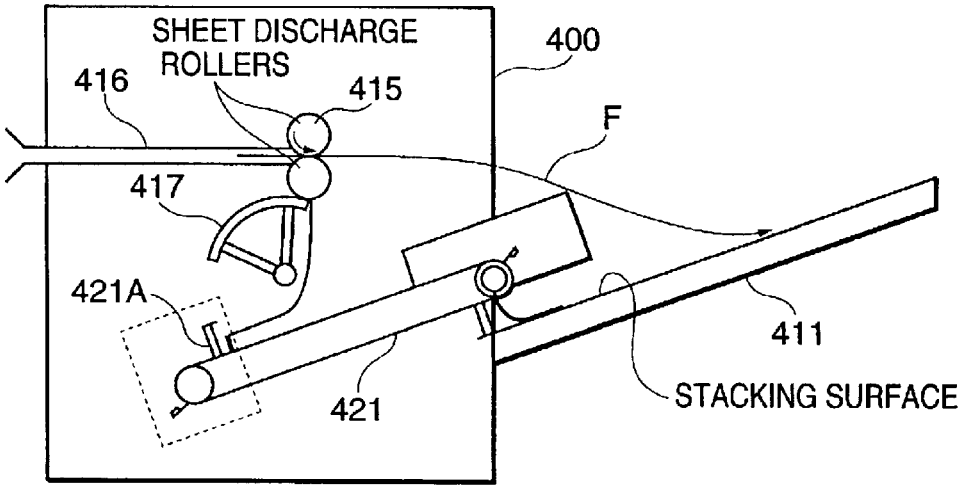
FIG. 23 is a view showing a trace of the leading ends of a sheet in the finisher 400.

A description will now be given of the position of the stack tray 411, which is suitable for discharging a bundle of sheets. If the bundle discharge belt 421 is too far from the stacking surface of the stack tray 411, a bundle of sheets cannot be stacked on the stack tray 411 in a reliable manner. The leading end of a sheet traces a path indicated by an arrow F in FIG. 23 while it is discharged by the sheet discharge rollers 415. Therefore, if the bundle discharge belt 421 is too close to the stacking surface of the stack tray 411, the leading end of the sheet is brought into contact with the stacking surface of the stack tray 411 at a wide angle. In this case, the sheet may not be smoothly stacked on the stack tray 411. This may cause jamming while the sheet discharge rollers 415 are conveying the sheet. To solve this problem, according to the present embodiment, the stack tray 411 is controlled to move up and down in the steps S162 to S169 to maintain the distance between the bundle discharge belt 421 and the stacking surface of the stack tray 411 at such a distance that prevents jamming and realizes reliable stackability.

In the case where the height sensor S10 is used to detect the top surface of sheets on the stack tray 411, if the top surface of sheets cannot be detected while the stack tray 411 is moving down, the distance between the bundle discharge belt 421 and the stacking surface of the stack tray 411 cannot be accurately controlled. To address this problem, it may be considered that the thickness of a bundle is estimated according to the number of sheets discharged in the bundle, but the thickness of the bundle is not necessarily equal to the estimated thickness because the thickness varies according to sheets. Supposing that the discharged bundle of sheets has a greater thickness than the estimated thickness, there is a high possibility that the sheets may be jammed due to a short distance between the bundle discharge belt 421 and the stacking surface of the stack tray 411 as described above.

To solve this problem, according to the present embodiment, if the stack tray 411 has reached the lower limit position, the control in the steps S170 to S173 is carried out to discharge the remaining bundle or bundles of sheets without moving up the stack tray 411. This prevents occurrence of jamming even if the distance between the bundle discharge belt 421 and the stacking surface of the stack tray 411 is decreased. Moreover, the bundle or bundles of sheets discharged on this occasion is/are a bundle or bundles in the last part of the job, there is no serious problem even if the stackability on the stack tray 411 is deteriorated to some extent.

Figure 24:
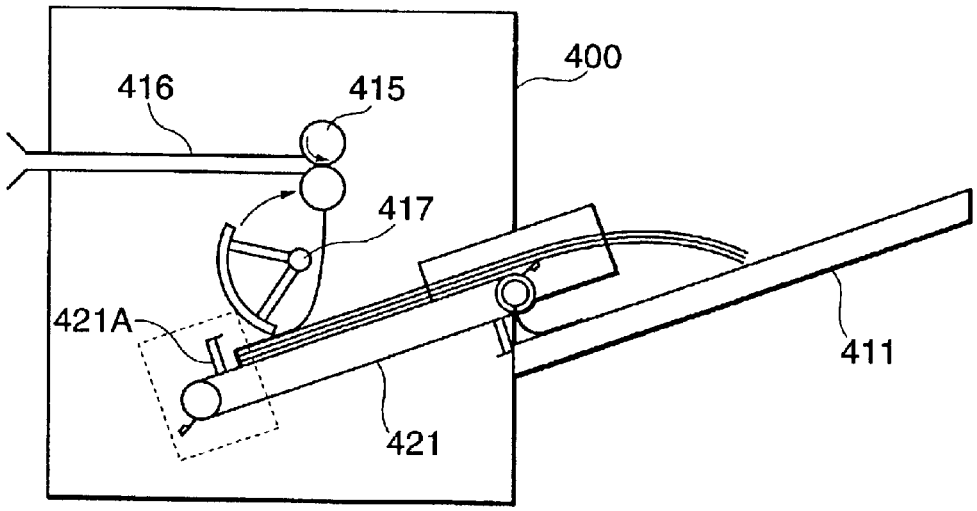
FIG. 24 is a view showing a state of sheets in the finisher 400.

It should be noted that the bundle discharge belt 421 of the finisher 400 is designed to be relatively short in order to reduce the size and cost of the finisher 400. If a long sheet such as an A4R sheet or an A3 sheet is processed, a part of the sheet that cannot be covered by the bundle discharge belt 421 is supported by the stack tray 411 (FIG. 24).

Further, when the image forming apparatus starts an image formation job in the staple mode, if the sensor S11 (refer to FIG. 11) detects sheets stacked on the stack tray 411, the image forming apparatus displays the message "Remove sheets from the stack tray" on the operating section 1 to ask the user to remove the sheets from the stack tray 411. At the start of the image formation job, it is preferable that no sheet is stacked on the stack tray 411 because the stackability is deteriorated by overlapping of stapled parts if stapled bundles of sheets are stacked on the stack tray 411. However, since the image forming apparatus is used in a printer mode as well as in a copy mode, the image forming apparatus is configured such that the image formation job can be started even if the sheets have been not removed in the case where the user is not present.

At a time point when the image forming apparatus completes a job of forming images continuously on thirty sheets, the image forming apparatus temporarily stops the job to display the message "Remove sheets from the stack tray" on the operating section 1, and suspends restart of the job until the sensor S11 is turned off in response to removal of the sheets from the stack tray 411.

Figure 25:
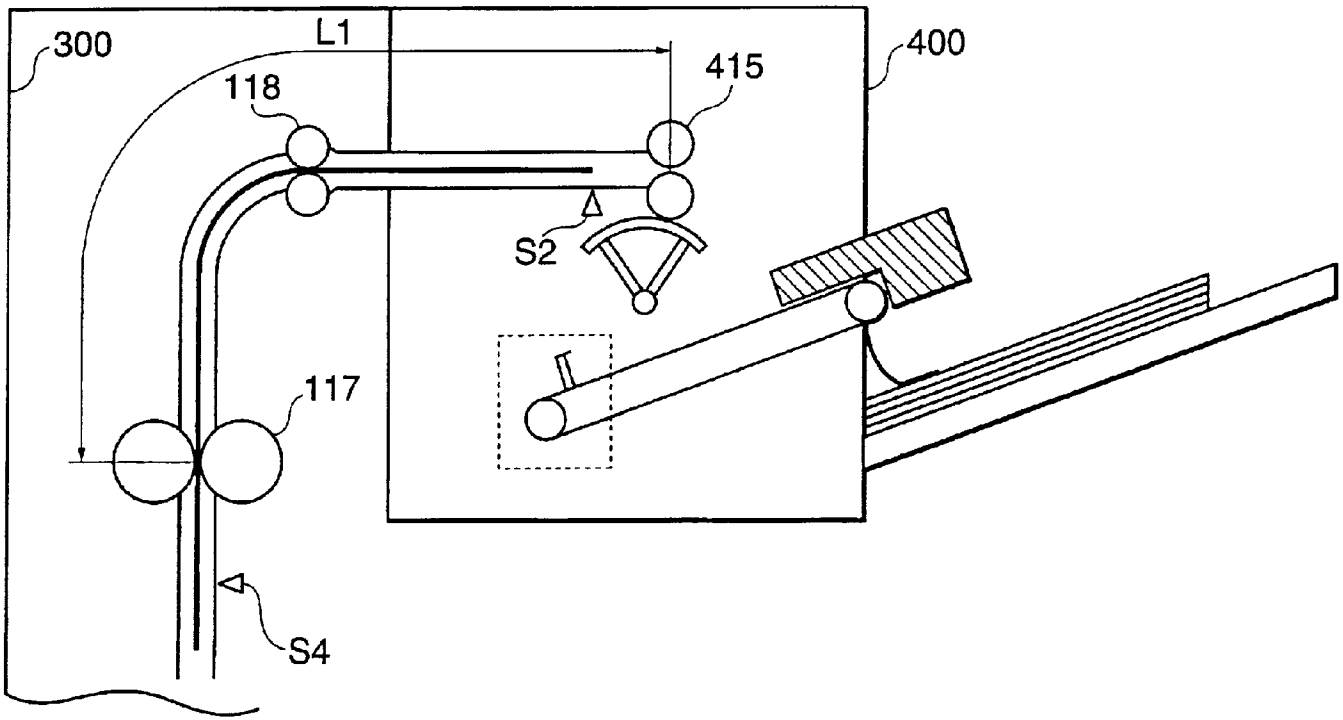
FIG. 25 is a view showing a sheet that is being conveyed from the printer 300 toward the finisher 400.

FIG. 25 is a view showing a sheet that is being conveyed from the printer 300 to the finisher 400.

The sheet is conveyed by the fixing rollers 117 and the discharge rollers 118 in the printer 300. On this occasion, the fixing rollers 117 are rotating at a predetermined rotational speed and the discharge rollers 18 are rotating at a constant rotational speed higher than the rotational speed of the fixing roller 117. In a state in which the sheet is not held by the fixing rollers 117, the sheet can be conveyed at a constant conveying speed (second conveying speed). The reason why the conveying speed of the discharge rollers 118 is higher than that of the fixing rollers 117 is to prevent the sheet having absorbed heat on the fixing rollers 117 from shrinking when it is self-cooled.

Further, to prevent pulling of the sheet by the discharge rollers 118 from exerting adverse effects on the fixing process, the conveying force (second conveying force) of the discharge rollers 118 is set to be weaker than the conveying force of the fixing rollers 117 (first conveying force). Therefore, even if the sheet is pulled by the discharge rollers 118, the sheet is conveyed at the conveying speed of the fixing rollers 117, whereby the sheet is prevented from slipping on the fixing rollers 117. This prevents damage to the sheet and poor toner fixing.

When the sheet is further conveyed so that the sensor S2 is turned on when the leading end of the sheet passes sensor S2 in the sheet stacking device 400, the CPU 491 in the finisher controller 401 (refer to FIG. 3) provides control to rotate the sheet discharge rollers 415 at a set rotational speed. Namely, the CPU 491 controls the sheet discharge rollers 415 such that the sheet is conveyed at the set conveying speed. It should be noted that information on the rotational speeds of the fixing rollers 117 and the discharge rollers 118 is transmitted from the CPU circuit controller 150 via the communication line 490, and is stored in the RAM 492 of the finisher controller 401.

Where the distance from the fixing rollers 117 to the sheet discharge rollers 415 is designated by L1 and the sheet length is less than L1, when the sheet discharge rollers 415 starts holding the sheet, the trailing end of the sheet is no more held by the fixing rollers 117. Hence, just before the sheet discharge rollers 415 starts holding the sheet, the sheet is conveyed at the conveying speed of the discharge rollers 118. Therefore, if the sheet length based on the sheet size information received via the communication line 490 is less than L1, when the CPU 491 (conveying speed setting means) starts rotating the sheet discharge rollers 415 after the leading end of the sheet passes the sensor S2 to turn on the sensor S2, the conveying speed of the sheet discharge rollers 415 is set to be equal to that of the discharge rollers 118 (second conveying speed).

Figure 26:
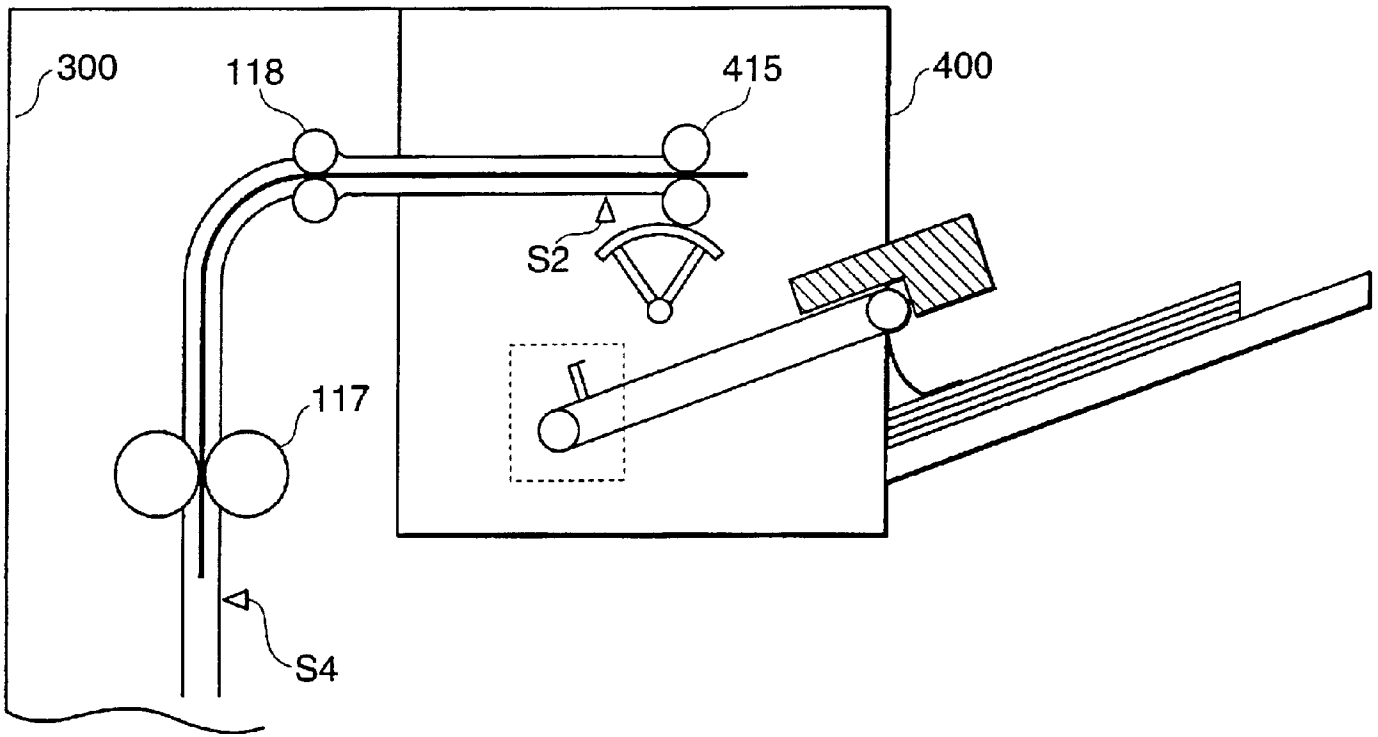
FIG. 26 is a view showing the sheet that is being further conveyed toward the finisher 400 from the state shown in FIG. 25.
Figure 27:
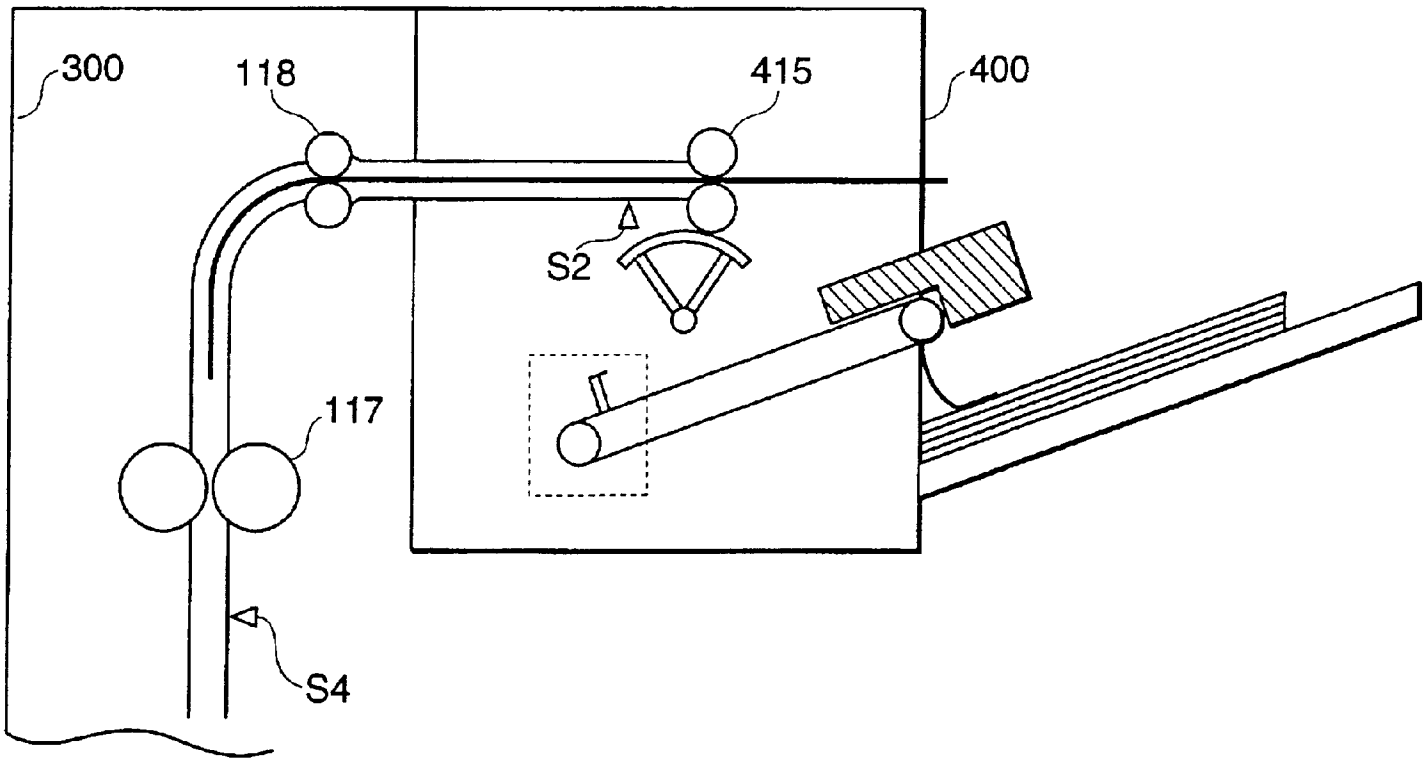
FIG. 27 is a view showing the sheet with the trailing end thereof getting out of the condition of FIG. 26.

In the case where the sheet length is equal to or greater than L1 as shown in FIG. 26, the sheet is conveyed at the rotational speed of the fixing rollers 117 even when the sheet discharge rollers 415 start holding the sheet, because the sheet is then still held by the fixing rollers 117. Therefore, if the sheet length based on the sheet size information received via the communication line 490 is equal to or greater than L1, when the CPU 491 starts rotating the sheet discharge rollers 415 after the leading end of the sheet passes the front end of the sensor S2 to turn on the sensor S2, the conveying speed of the sheet discharge rollers 415 is set to be equal to that of the fixing rollers 117 (first conveying speed). Therefore, the sheet is conveyed at the conveying speed of the fixing rollers 117, and this prevents a trouble in the fixing process carried out by the fixing rollers 117.

Thereafter, if the trailing end of the sheet is released from the fixing rollers 117, the sheet is conveyed by the discharge rollers 118 and the sheet discharge rollers 415. When the trailing end of the sheet is released from the fixing rollers 117, a release signal indicating the release of the sheet is transmitted from the CPU circuit controller 150 to the finisher controller 401 via the communication line 490. The release signal is transmitted in timing described later. In the finisher controller 401 having received the release signal, the CPU 491 provides control such that the conveying speed of the sheet discharge rollers 415 is set to be equal to that of the discharge rollers 118 (second conveying speed). This control enables the sheet to be conveyed from the printer 300 to the finisher 400 without forming a loop.

In response to the release of the trailing end of the sheet from the discharge rollers 118, the CPU 491 provides control to separate the sheet from a subsequent sheet by setting the conveying speed of the sheet discharge rollers 415 to a third conveying speed higher than the second conveying speed. Further, just before the trailing end of the sheet is released from the sheet discharge rollers 415, the CPU 491 sets the conveying speed of the sheet discharge rollers 415 to a fourth conveying speed lower than the third conveying speed to thus prevent the sheet from jumping excessively. In response to the release of the trailing end of the sheet from the sheet discharge rollers 415, the CPU 491 stops the rotation of the discharge rollers 415.

A description will now be given of the timing in which the CPU circuit controller 150 transmits the release signal to the finisher controller 401.

Figure 28:
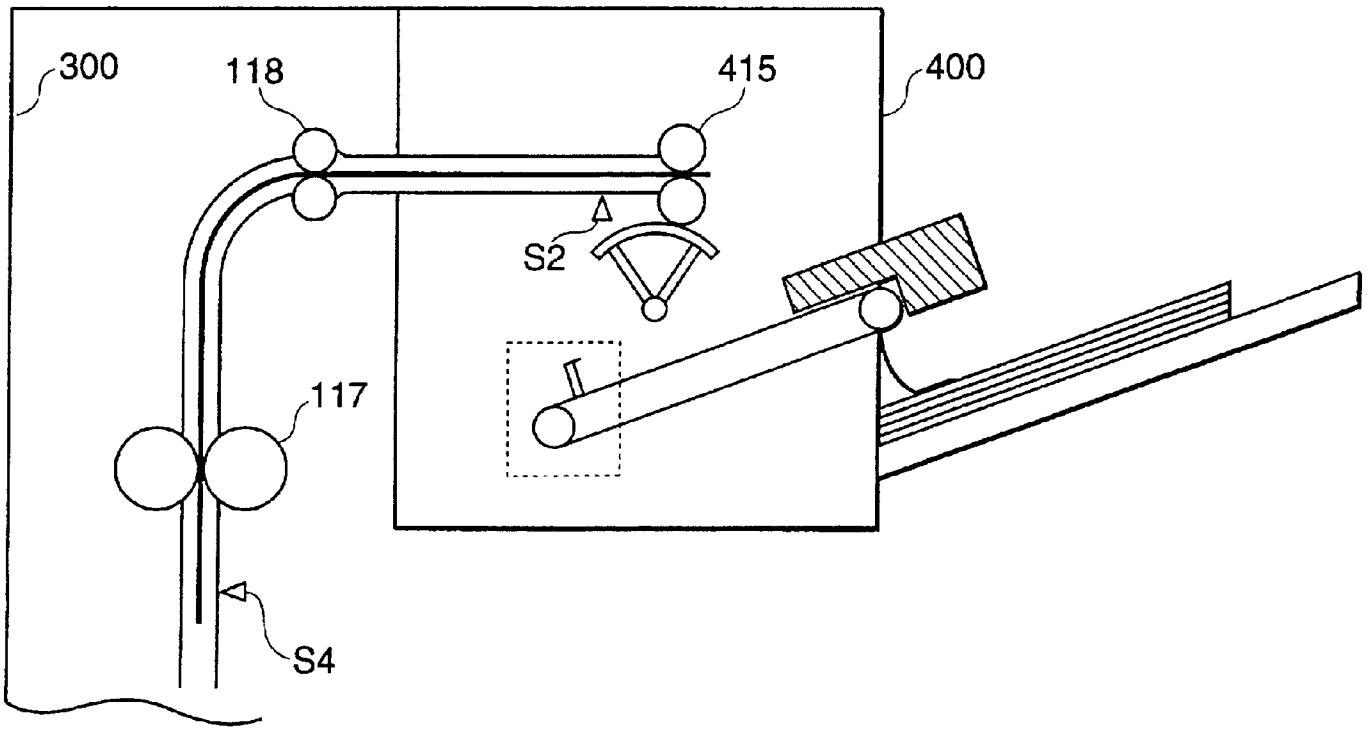
FIG. 28 is a view useful in explaining timing in which a separation signal is transmitted according to the position of a sheet.

FIG. 28 is a view useful in explaining the timing in which the release signal is transmitted according to the position of the sheet.

The timing in which the CPU circuit controls section 150 transmits the release signal to the finisher controller 401 is determined based on the detection of the trailing end of the sheet by the sensor S4 (determination means) disposed upstream of the fixing rollers 115 in the conveying direction.

Where the distance from the sensor S4 to the fixing rollers 117 is designated by L2, the conveying speed of the fixing rollers 117 is designated by v, and a period of time after the sensor S4 detects the trailing end of the sheet and before the CPU circuit controller 150 transmits the release signal is designated by U, the period of time U is expressed by the following expression:

$$U=L2/v \quad (1)$$

Thus, the CPU circuit controller 150 transmits the release signal to the finisher controller 401 upon lapse of the period of time U after the sensor S4 detects the trailing end of the sheet. Thus, the sheet discharge rollers 415 having conveyed the sheet at the same conveying speed as that of the fixing rollers 117 is controlled to convey the sheet at the same conveying speed as that of the discharge rollers 118 after the period of time U elapses after the sensor S4 detects the trailing end of the sheet.

According to the prior art, the sheet discharge rollers in the printer that is supposed to have a finisher attached thereto are provided with a one-way clutch. When the finisher is not attached to the printer, the sheet discharge rollers of the printer is used to discharge a sheet, and when the finisher is attached to the printer, a sheet released from the fixing rollers is conveyed at the conveying speed of the finisher so that the sheet can be prevented from being affected by the conveying speed of the sheet discharge rollers. The finisher 400 according to the present embodiment, however, eliminates the necessity of providing a one-way clutch for the sheet discharge rollers of the printer that is supposed to have the finisher 400 attached thereto, thereby reducing the cost as compared with the conventional printer (image forming apparatus).

Conventionally, there has also been a printer (image forming apparatus) that directly drives discharge rollers without providing a one-way clutch for the purpose of saving the cost. This printer has the disadvantage that a serviceman must detach the discharge rollers from the printer when attaching a finisher to the printer. The finisher 400 according to the present embodiment, however, eliminates the necessity of detaching the discharge rollers by a serviceman, and thus makes the printer more user-friendly.

What is claimed is:

1. A sheet processing apparatus that receives a sheet discharged from an image forming apparatus comprising first conveying means for conveying a sheet, on which is formed an image, at a first conveying speed and with a first conveying force, second conveying means disposed downstream of the first conveying means in a sheet conveying direction, for conveying the sheet at a second conveying speed higher than the first conveying speed and with a second conveying force smaller the first conveying force, and determination means for determining whether a trailing end of the sheet is released from the first conveying means, the sheet processing apparatus comprising:

third conveying means for conveying the received sheet; and conveying speed setting means for setting a conveying speed of said third conveying means to the first conveying speed while the sheet is being conveyed by all of the first conveying means, the second conveying means, and said third conveying means, and for setting the conveying speed of said third conveying means to the second conveying speed after the determination means determines that the trailing end of the sheet is released from the first conveying means.

2. A sheet processing apparatus that receives a sheet discharged from an image forming apparatus comprising first conveying means for conveying a sheet, on which is formed an image, at a first conveying speed and with a first conveying force, second conveying means disposed downstream of the first conveying means in a sheet conveying direction, for conveying the sheet at a second conveying speed higher than the first conveying speed and with a second conveying force smaller the first conveying force, and determination means for determining whether a trailing end of the sheet is released from the first conveying means, the sheet processing apparatus comprising:

third conveying means for conveying the received sheet; and conveying speed setting means for setting a conveying speed of said third conveying means to the first conveying speed while the sheet is being conveyed by all of the first conveying means, the second conveying means, and said third conveying means, and for setting the conveying speed of said third conveying means to the second conveying speed after the determination means determines that the trailing end of the sheet is released from the first conveying means, wherein said conveying speed setting means sets the conveying speed of said third conveying means to the second conveying speed when the determination means determines that the trailing end of the sheet is released from the first conveying means before a leading end of the sheet reaches said third conveying means.

3. A sheet processing apparatus according to claim 1, wherein said conveying speed setting means is responsive to release of the trailing end of the sheet from the second conveying means, for setting the conveying speed of said third conveying means to a third conveying speed higher than the second conveying speed.

4. A sheet processing apparatus according to claim 1, wherein the first conveying means comprises fixing means for fixing an image on the sheet while conveying the sheet.

5. A sheet processing apparatus according to claim 1, comprising an original reading apparatus that reads an original, provided at an upper side of the image forming apparatus, and wherein the sheet processing apparatus is provided between the image forming apparatus and the original reading apparatus.

6. A sheet processing apparatus according to claim 1, wherein the determination means includes a sensor disposed upstream of the first conveying means in the sheet conveying direction, and wherein said determination means determines that the trailing end of the sheet is released from the first conveying means when a predetermined period elapses after said sensor detects the trailing end of the sheet.

7. A sheet processing apparatus according to claim 6, wherein the predetermined time period is a period of time U defined by:

$$U=L2/v,$$

where L2 represents a distance from the sensor to the first conveying means, and v represents the first conveying speed.

8. A sheet processing apparatus that receives a sheet discharged from an image forming apparatus comprising first conveying means for conveying a sheet on which is formed an image at a first conveying speed and with a first conveying force, second conveying means disposed downstream of the first conveying means in a sheet conveying direction, for conveying the sheet at a second conveying speed higher than the first conveying speed and with a second conveying force smaller than the first conveying force, and determination means for determining whether a trailing end of the sheet is released from the first conveying means, the sheet processing apparatus comprising:

third conveying means for conveying the received sheet; and conveying speed setting means for setting a conveying speed of said third conveying means to the first conveying speed or the second conveying speed according to information on a size of the sheet received from the image forming apparatus, wherein said conveying speed setting means sets the conveying speed of said third conveying means to the second conveying speed when a sheet length indicated by the information on the size of the she received from the image forming apparatus is smaller than a predetermined length, and said conveying speed setting means sets the conveying speed of said third conveying means to the first conveying speed when the sheet length indicated by the information on the size of the sheet received from the image forming apparatus is equal to or greater than the predetermined length.

9. A sheet processing apparatus according to claim 8, wherein when the conveying speed of said third conveying means is set to the first conveying means, said conveying speed setting means sets the conveying speed of said third conveying means to the second conveying speed after the determination means determines that the trailing end of the sheet is released from the first conveying means.

10. A sheet processing apparatus according to claim 8, wherein said conveying speed setting means is responsive to release of the trailing end of the sheet from the second conveying means, for setting the conveying speed of said third conveying means to a third conveying speed higher than the second conveying speed.

11. An image forming system comprising an image forming apparatus and a sheet processing apparatus, wherein:

said image forming apparatus comprises:

first conveying means for conveying a sheet on which is formed an image at a first conveying speed and with a first conveying force;

second conveying means disposed downstream of the first conveying means in a sheet conveying direction, for conveying the sheet at a second conveying speed higher than the first conveying speed and with a second conveying force smaller than the first conveying force; and determination means for determining whether a trailing end of the sheet is released from the first conveying means; and wherein:

said sheet processing apparatus comprises:

third conveying means for conveying the received sheet; and conveying speed setting means for setting a conveying speed of said third conveying means to the first conveying speed while the sheet is being conveyed by all of the first conveying means, the second conveying means, and said third conveying means, and for setting the conveying speed of said third conveying means to the second conveying speed after the determination means determines at the trailing end of the sheet is released from the first conveying means.

12. An image forming system comprising an image forming apparatus and a sheet processing apparatus, wherein:

said image forming apparatus comprises:

first conveying means for conveying a sheet on which is formed an image at a first conveying speed and with a first conveying force;

second conveying means disposed downstream of the first conveying means in a sheet conveying direction, for conveying the sheet at a second conveying speed higher than the first conveying speed and with a second conveying force smaller than the first conveying force; and determination means for determining whether a trailing end of the sheet is released from the first conveying means; and wherein:

said sheet processing apparatus comprises:

third conveying means for conveying the received sheet; and conveying speed setting means for setting a conveying speed of said third conveying means to the first conveying speed or the second conveying speed according to information on a size of the sheet received from the image forming apparatus, wherein said conveying speed setting means sets the conveying speed of said third conveying means to the second conveying speed when a sheet length indicated by the information on the size of the sheet received from the image forming apparatus is smaller than a predetermined length, and said conveying speed setting means sets the conveying speed of said third conveying means to the first conveying speed when the sheet length indicated by the information on the size of the sheet received from the image forming apparatus is equal to or greater than the predetermined length.

13. A sheet processing apparatus that receives a sheet discharged from an image forming apparatus comprising a first conveying device that conveys a sheet, on which is formed an image, at a first conveying speed and with a first conveying force, a second conveying device that is disposed downstream of the first conveying device in a sheet conveying direction, and conveys the sheet at a second conveying speed higher than the first conveying speed and with a second conveying force smaller than the first conveying force, and a determination device that determines whether a trailing end of the sheet is released from the first conveying device, the sheet processing apparatus comprising:

a third conveying device the conveys the received sheet; and a conveying speed setting device that sets a conveying speed of said third conveying device to the first conveying speed while the sheet is being conveyed by all of the first conveying device, the second conveying device, and said third conveying device, and sets the conveying speed of said third conveying device to the second conveying speed after the determination device determines that the trailing end of the sheet is released from the first conveying device.

14. A sheet processing apparatus that receives a sheet discharged from an image forming apparatus comprising a first conveying device that conveys a sheet on which is formed an image at a first conveying speed and with a first conveying force, a second conveying device that is disposed downstream of the first conveying device in a sheet conveying direction, and conveys the sheet at a second conveying speed higher than the first conveying speed and with a second conveying force smaller than the first conveying force, and a determination device that determines whether a trailing end of the sheet is released from the first conveying device, the sheet processing apparatus comprising:

a third conveying device and conveys the received sheet; and a conveying speed setting device that sets a conveying speed of said third conveying device to the first conveying speed or the second conveying speed according to information on a size of the sheet received from the image forming apparatus, wherein said conveying said setting device sets the conveying speed of said third conveying device to the second conveying speed when a sheet length indicated by the information on the size of the sheet received from the image forming apparatus is smaller than a predetermined length, and said conveying speed setting device sets the conveying speed of said third conveying device to the first conveying speed when the sheet length indicated by the information on the size of the sheet received from the image forming apparatus is equal to or greater than the predetermined length.

15. An image forming system comprising an image forming apparatus and a sheet processing apparatus, wherein:

said image forming apparatus comprises:

a first conveying device that conveys a sheet on which is formed an image at a first conveying speed and with a first conveying force;

a second conveying device that is disposed downstream of the first conveying device in a sheet conveying direction, and conveys the sheet at a second conveying speed higher than the first conveying speed and with a second conveying force smaller than the first conveying force; and a determination device that determines whether a trailing end of the sheet is released from the first conveying device; and wherein:

said sheet processing apparatus comprises:

a third conveying device for conveying the received sheet; and a conveying speed setting device for setting a conveying speed of said third conveying device to the first conveying speed while the sheet is being conveyed by all of the first conveying devices, the second conveying device, and said third conveying device, and for setting the conveying speed of said third conveying device to the second conveying speed after the determination device determines that the trailing end of the sheet is released from the first conveying device.

16. An image forming system comprising an image forming apparatus and a sheet processing apparatus, wherein:

said image forming apparatus comprises:

a first conveying device that conveys a sheet on which is formed an image at a first conveying speed and with a first conveying force;

a second conveying device that is disposed downstream of the first conveying device in a sheet conveying direction, and conveys the sheet at a second conveying speed higher than the first conveying speed and with a second conveying force smaller than the first conveying force; and a determination device that determines whether a trailing end of the sheet is released from the first conveying device; and wherein:

said sheet processing apparatus comprises:

a third conveying device for conveying the received sheet; and a conveying speed setting device for setting a conveying speed of said third conveying device to the first conveying speed or the second conveying speed according to information on a size of the sheet received from the image forming apparatus, wherein said conveying speed setting device sets the conveying speed of said third conveying device to the second conveying speed when a sheet length indicated by the information on the size of the sheet received from the image forming apparatus is smaller than a predetermined length, and said conveying speed setting device sets the conveying speed of said third conveying device to the first conveying speed when the sheet length indicated by the information on the size of the sheet received from the image forming apparatus is equal to or greater than the predetermined length.

17. A sheet processing apparatus that receives a sheet discharged from an image forming apparatus comprising a first conveying device that conveys a sheet, on which is formed an image, at a first conveying speed and with a first conveying force, a second conveying device disposed downstream of the first conveying device in a sheet conveying direction, and conveys the sheet at a second conveying speed higher than the first conveying speed and with a second conveying force smaller than the first conveying force, and a determination device that determines whether a trailing end of the sheet is released from the first conveying device, the sheet processing apparatus comprising:

a third conveying device that conveys the received sheet; and a conveying speed setting device that sets a conveying speed of said third conveying device to the first conveying speed while the sheet is being conveyed by all of the first conveying device, the second conveying device, and said third conveying device, and sets the conveying speed of said third conveying device to the second conveying speed after the determination device determines that the trailing end of the sheet is released from the first conveying device, wherein said conveying speed setting device sets the conveying speed of said third conveying device to the second conveying speed when the determination device determines that the trailing end of the sheet is released from the first conveying device before a leading end of the sheet reaches said third conveying device.

* * * * *